US010094575B2

(12) United States Patent
Evans et al.

(10) Patent No.: US 10,094,575 B2
(45) Date of Patent: Oct. 9, 2018

(54) ADJUSTABLE OVERHEAD COOKING UNIT

(71) Applicant: Hestan Commercial Corporation, Anaheim, CA (US)

(72) Inventors: Jay Hamilton Evans, Carson, CA (US); Chris Moy, Monterey Park, CA (US)

(73) Assignee: Hestan Commercial Corporation, Anaheim, CA (US)

( * ) Notice: Subject to any disclaimer, the term of this patent is extended or adjusted under 35 U.S.C. 154(b) by 333 days.

(21) Appl. No.: 14/993,461

(22) Filed: Jan. 12, 2016

(65) Prior Publication Data

US 2016/0201926 A1 Jul. 14, 2016

Related U.S. Application Data

(63) Continuation-in-part of application No. 14/992,690, filed on Jan. 11, 2016.

(60) Provisional application No. 62/102,246, filed on Jan. 12, 2015.

(51) Int. Cl.
*F24C 15/16* (2006.01)
*F24C 15/30* (2006.01)

(52) U.S. Cl.
CPC ..... *F24C 15/30* (2013.01); *F24C 15/16* (2013.01)

(58) Field of Classification Search
CPC ..... F24C 15/16; A47B 57/06
USPC ..... 108/106, 147.16, 146; 211/103, 153, 211/207, 208, 90.02
See application file for complete search history.

(56) References Cited

U.S. PATENT DOCUMENTS 1,922,585 A * 8/1933 Hoffstetter ..... F24C 15/16 126/337 A
1,954,580 A * 4/1934 Toomey ..... F24C 3/027 126/214 D
2,682,831 A * 7/1954 Pellegrin ..... A47J 37/06 126/24
2,876,695 A * 3/1959 Racheter ..... A47J 37/041 126/340
3,982,801 A * 9/1976 Heidorn ..... A47B 57/06 108/147
D321,804 S * 11/1991 Wolff ..... D18/56
5,069,350 A * 12/1991 Wolff ..... A47F 5/0807 211/106.01
8,333,448 B2 * 12/2012 Yoon ..... A47B 96/028 108/108
8,800,785 B2 * 8/2014 Kalafut ..... A47F 5/0861 211/103

(Continued)

*Primary Examiner* — Jorge Pereiro
(74) *Attorney, Agent, or Firm* — Akerman LLP

(57) ABSTRACT

According to one embodiment, a cooking unit includes a rear housing, a heating chamber coupled to the rear housing, and one or more vertical tracks coupled to the rear housing. The cooking unit further includes a support shelf coupled to the vertical tracks, and operable to be moved vertically along the vertical tracks. The cooking unit also includes a sliding tray coupled to the support shelf, and operable to be moved horizontally with respect to the rear housing. The cooking unit further includes a handle coupled to a front surface of the sliding tray, and an actuator positioned adjacent to the handle so as to allow both the handle to be grasped and the actuator engaged by a single hand of a user. The actuator is operable to unlock the horizontal support shelf so as to allow the horizontal support shelf to be moved vertically along the vertical tracks.

22 Claims, 9 Drawing Sheets

(56) References Cited

U.S. PATENT DOCUMENTS

| | | | | |
|---|---|---|---|---|
| 8,985,032 | B1 * | 3/2015 | Johnson | A47B 21/02 108/106 |
| 2006/0086352 | A1 * | 4/2006 | Bally | A47B 77/04 126/19 R |
| 2008/0048081 | A1 * | 2/2008 | Costa | A47B 57/00 248/241 |
| 2009/0001069 | A1 * | 1/2009 | Bally | F24C 15/027 219/413 |
| 2010/0117502 | A1 * | 5/2010 | Kang | F25D 25/02 312/408 |
| 2014/0238279 | A1 * | 8/2014 | Maas | A47B 9/02 108/146 |

* cited by examiner

ADJUSTABLE OVERHEAD COOKING UNIT

CROSS-REFERENCE TO RELATED APPLICATIONS

This application claims the benefit of priority as a continuation-in-part to U.S. patent application Ser. No. 14/992,690, filed Jan. 11, 2016, which claims the benefit of priority to U.S. Provisional Patent Application No. 62/102,246, filed Jan. 12, 2015, the entirety of which is incorporated herein.

TECHNICAL FIELD

This disclosure relates generally to the field of cooking units and more specifically to an adjustable overhead cooking unit.

BACKGROUND

Traditionally, overhead cooking units may have a shelf positioned underneath a heating device. As such, food can be placed on the shelf, and the heating device may heat (or cook) the food. These traditional overhead cooking units, however, may be deficient.

SUMMARY

A first aspect of the invention is achieved by providing a cooking unit, comprising a rear housing; a horizontal gas combustion chamber coupled to the rear housing, the horizontal gas combustion chamber being operable to direct heat downward; a pair of vertical tracks coupled to the rear housing; a horizontal support shelf coupled to the pair of vertical tracks and positioned below the horizontal gas combustion chamber, the horizontal support shelf being operable to be moved vertically along the pair of vertical tracks; a horizontal sliding tray coupled to the horizontal support shelf and positioned above the horizontal support shelf, the horizontal sliding tray being operable to be moved horizontally with respect to the rear housing; a handle coupled to a front surface of the horizontal sliding tray; an actuator positioned adjacent to the handle so as to allow both the handle to be grasped and the actuator engaged by a single hand of a user, the actuator being operable, when engaged, to unlock the horizontal support shelf so as to allow the horizontal support shelf to be moved vertically along the pair of vertical tracks using the handle and the single hand of the user, the actuator being further operable, when not engaged, to lock the horizontal support shelf so as to prevent the horizontal support shelf from being moved vertically along the pair of vertical tracks; a vertical flat gear coupled to the rear housing, wherein the vertical flat gear is positioned laterally in-between the pair of vertical tracks; and a gear stop having a portion positioned in a portion of the vertical flat gear, wherein the gear stop is coupled, at least indirectly, to the actuator, wherein the actuator is operable, when engaged, to remove the portion of the gear stop from the position in the portion of the vertical flat gear so as to unlock the horizontal support shelf.

Another aspect of the invention is any such cooking unit, wherein the cooking unit is operable to be coupled to a vent flue.

Another aspect of the invention is any such cooking unit, further comprising a pair of brackets coupled to a rear face of the rear housing, the pair of brackets being operable to be inserted into an upper opening of a cavity of a vent flue.

A second aspect of the invention is achieved by providing a cooking unit, comprising a rear housing; a horizontal heating chamber coupled to the rear housing, the horizontal heating chamber being operable to direct heat downward; one or more vertical tracks coupled to the rear housing; a horizontal support shelf coupled to the one or more vertical tracks and positioned below the horizontal heating chamber, the horizontal support shelf being operable to be moved vertically along the one or more vertical tracks; a horizontal sliding tray coupled to the horizontal support shelf and positioned above the horizontal support shelf, the horizontal sliding tray being operable to be moved horizontally with respect to the rear housing; a handle coupled to a front surface of the horizontal sliding tray; and an actuator positioned adjacent to the handle so as to allow both the handle to be grasped and the actuator engaged by a single hand of a user, the actuator being operable, when engaged, to unlock the horizontal support shelf so as to allow the horizontal support shelf to be moved vertically along the one or more vertical tracks using the handle and the single hand of the user, the actuator being further operable, when not engaged, to lock the horizontal support shelf so as to prevent the horizontal support shelf from being moved vertically along the one or more vertical tracks.

Another aspect of the invention is any such cooking unit, wherein the horizontal heating chamber is a horizontal gas combustion chamber.

Another aspect of the invention is any such cooking unit, wherein the one or more vertical tracks comprise at least two vertical tracks.

Another aspect of the invention is any such cooking unit, further comprising a vertical flat gear coupled to the rear housing; and a gear stop having a portion positioned in a portion of the vertical flat gear, wherein the gear stop is coupled, at least indirectly, to the actuator, wherein the actuator is operable, when engaged, to remove the portion of the gear stop from the position in the portion of the vertical flat gear so as to unlock the horizontal support shelf.

Another aspect of the invention is any such cooking unit, wherein the one or more vertical tracks comprise two vertical tracks, and the vertical flat gear is positioned laterally in-between the two vertical tracks.

Another aspect of the invention is any such cooking unit, wherein the horizontal support shelf is further operable to be moved vertically along the one or more vertical tracks while the horizontal sliding tray is positioned at a maximum forward horizontal position with respect to the rear housing.

Another aspect of the invention is any such cooking unit, wherein the actuator is operable to be moved forward towards the handle so as to be engaged.

Another aspect of the invention is any such cooking unit, wherein the cooking unit is operable to be coupled to a vent flue.

Another aspect of the invention is any such cooking unit, further comprising a pair of brackets coupled to a rear face of the rear housing, the pair of brackets being operable to be inserted into an upper opening of a cavity of a vent flue.

Another aspect of the invention is any such cooking unit, wherein the actuator is positioned within a range of approximately 6 inches-approximately 1 inch from the handle, so as to allow both the handle to be grasped and the actuator engaged by a single hand of a user.

Another aspect of the invention is any such cooking unit, wherein the actuator is positioned less than approximately 3 inches from the handle, so as to allow both the handle to be grasped and the actuator engaged by a single hand of a user.

A third aspect of the invention is achieved by performing a method comprising providing a cooking unit, the cooking unit comprising a rear housing; a horizontal heating chamber coupled to the rear housing, the horizontal heating chamber being operable to direct heat downward; one or more vertical tracks coupled to the rear housing; a horizontal support shelf coupled to the one or more vertical tracks and positioned below the horizontal heating chamber; a horizontal sliding tray coupled to the horizontal support shelf and positioned above the horizontal support shelf; a handle coupled to a front surface of the horizontal sliding tray; and an actuator positioned adjacent to the handle; grasping the handle with a first hand; engaging the actuator with the first hand so as to unlock the horizontal support shelf; and moving the horizontal support shelf vertically along the one or more vertical tracks using the handle.

Another aspect of the invention is any such method, wherein moving the horizontal support shelf vertically along the one or more vertical tracks using the handle comprises raising the horizontal support shelf toward the horizontal heating chamber.

Another aspect of the invention is any such method, wherein moving the horizontal support shelf vertically along the one or more vertical tracks using the handle comprises lowering the horizontal support shelf away from the horizontal heating chamber.

Another aspect of the invention is any such method, further comprising unengaging the horizontal support shelf so as to lock the horizontal support shelf to prevent the horizontal support shelf from being moved vertically along the one or more vertical tracks.

Another aspect of the invention is any such method, wherein engaging the actuator with the first hand comprises moving the actuator toward the handle using the first hand.

Another aspect of the invention is any such method, further comprising moving the horizontal sliding tray horizontally with respect to the rear housing.

Another aspect of the invention is any such method, further comprising providing a vent flue; and coupling the cooking unit to the vent flue.

Another aspect of the invention is any such method, wherein the cooking unit further comprises a pair of brackets coupled to a rear face of the rear housing; and wherein the method further comprises inserting the pair of brackets into an upper opening of a cavity of the vent flue.

BRIEF DESCRIPTION OF THE FIGURES

For a more complete understanding of the present disclosure and its features and advantages, reference is now made to the following description, taken in conjunction with the accompanying drawings, in which.

DETAILED DESCRIPTION

Embodiments of the present disclosure are best understood by referring to FIGS. 1A-6 of the drawings, like numerals being used for like and corresponding parts of the various drawings.

Traditionally, overhead cooking units may have a shelf positioned underneath a heating device. As such, food can be placed on the shelf, and the heating device may heat (or cook) the food. These traditional overhead cooking units, however, may be deficient. For example, some of these traditional overhead cooking units may have a shelf that is adjustable, so it may be raised and lowered. However, adjusting this traditional shelf may be burdensome because it may require 2 hands. In particular, the shelf may have a release mechanism that allows the shelf to be adjusted, but this release mechanism may be located away from the shelf itself. As such, to adjust the shelf, a user may need to use their first hand to engage the release mechanism, and also use their second hand to adjust the shelf. This 2-handed approach prevents the user from holding other items while adjusting the shelf, such as preventing the user from holding the food to be cooked, wearing an oven mitt that may be used to prevent the user from being burned, or holding a towel, tray, plate, or utensil. Contrary to such typical deficiencies, the cooking unit 100 of FIGS. 1A-5B may provide one or more advantages.

Figure 1A:
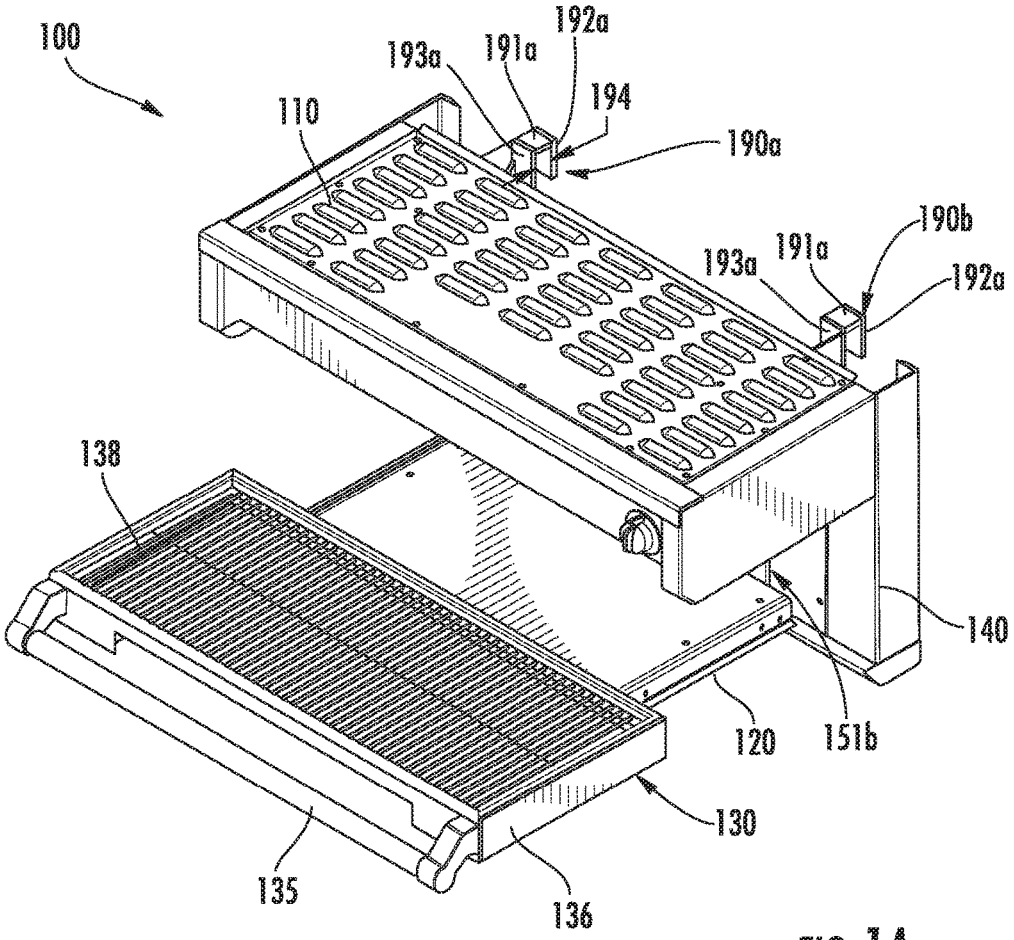
FIGS. 1A-1B illustrate an example cooking unit.
Figure 1B:
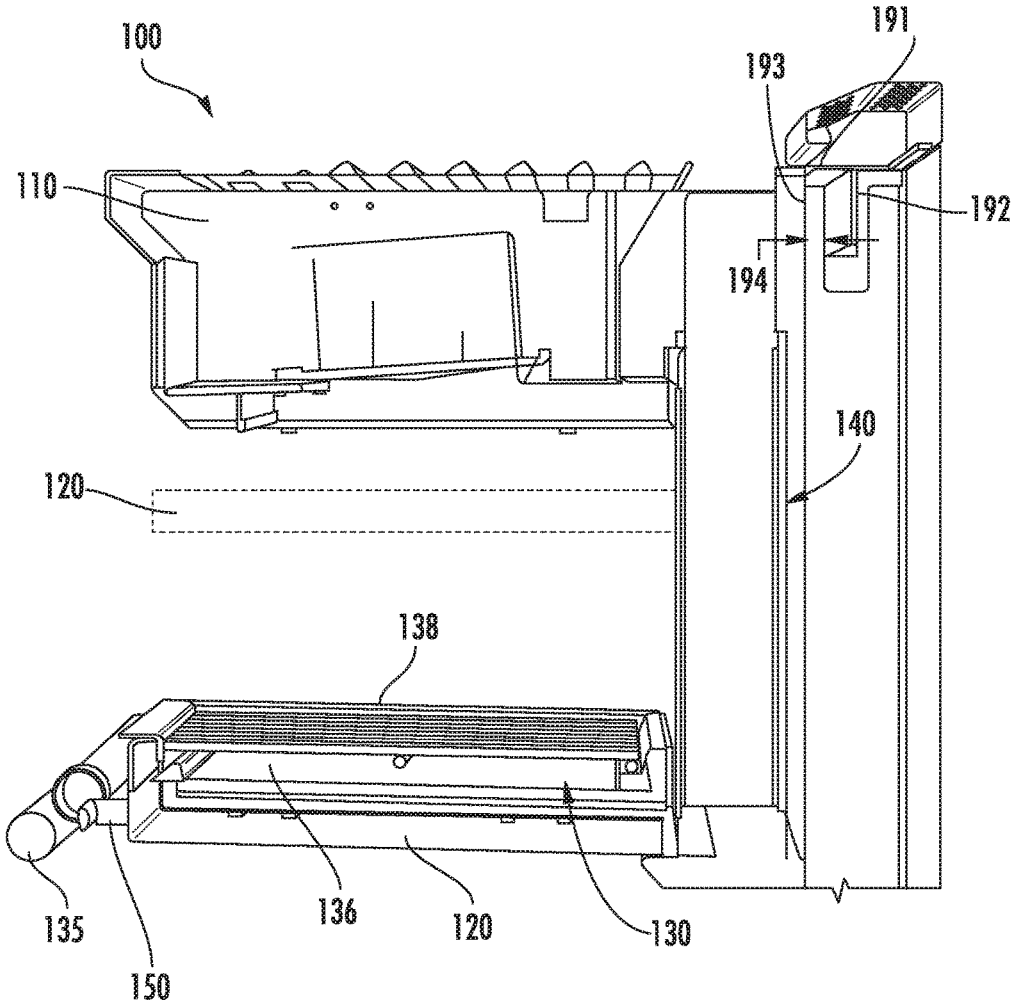

FIGS. 1A-1B illustrate an example cooking unit. In particular, FIG. 1A illustrates a front perspective view of a cooking unit 100, and FIG. 1B illustrates a partial cross-sectional view of the cooking unit 100. As illustrated, the cooking unit 100 includes a heating chamber 110 and one or more vertical tracks 151 coupled to a housing 140. Furthermore, the cooking unit 100 also includes a support shelf 120 coupled to the vertical tracks 151, and a sliding tray 130 with a handle 135 coupled to the support shelf 120. Also, the cooking unit 100 includes an actuator 150 positioned adjacent to the handle 135. When the actuator 150 is engaged, for example, the actuator 150 may unlock the support shelf 120, allowing the support shelf 120 to be moved vertically along the vertical tracks 151. When in use, a user may grasp the handle 135 and engage the actuator 150 with the same hand. As such, the user may simultaneously unlock the support shelf 120 and also lift and/or lower the support shelf 120 using the same hand. Therefore, the vertical positioning of the support shelf 120 may be adjusted using only one hand, which may allow the user to adjust the vertical position of the support shelf 120 while also utilizing a second hand to, for example, hold food to be cooked, wear an oven mitt that may be used to prevent the user from being burned, or hold a towel, tray, plate, or utensil.

A cooking unit 100 may be any type of unit for cooking. For example, the cooking unit 100 may be an overhead cooking unit 100. In such an example, the cooking unit 100 may be positioned off the floor of a kitchen, such as placed above tables, other cooking devices (such as an oven, a fryer, a steamer, etc.), or other kitchen units (such as a sink, a dishwasher, etc.). Therefore, the cooking unit 100 may take up less floor space of a kitchen, leaving the floor space for other cooking devices or free space for use by kitchen personnel. The cooking unit 100 may be any type of overhead cooking unit. For example, the cooking unit 100 may be a salamander. A salamander may be a small self-contained broiler unit that may be used to finish or brown food. As another example, the cooking unit 100 may be a cheese melter. A cheese melter may be a cooking appliance powered by direct flame or electricity, that allows a person to put finishing touches on food, especially food topped with shredded cheese. As illustrated, the cooking unit 100 is a salamander.

As is illustrated, the cooking unit 100 includes a rear housing 140. The rear housing 140 may be any structure that may support one or more features of the cooking unit 100.

For example, the rear housing 140 may be a slab, a panel, a board, a sheet, one or more bars, one or more rods, one or more pipes, any other structure that may support one or more features of the cooking unit 100, or any combination of the preceding. A feature of the cooking unit 100 may include any type of feature. For example, the feature may be the heating chamber 110, the vertical tracks 151, the support shelf 120, the sliding tray 130, any other cooking feature, any other kitchen feature, or any combination of the preceding.

The rear housing 140 may be made of (or constructed of) any material. For example, the rear housing 140 may be made of steel, stainless steel, aluminum, iron, brass, titanium, any other metal or metal alloy (including coated, plated and clad metals), any other material that is sufficiently strong and stable while enduring long term exposure to heat, or any combination of the preceding. Additionally, the rear housing 140 may be hollow, or it may be solid.

Figure 3A:
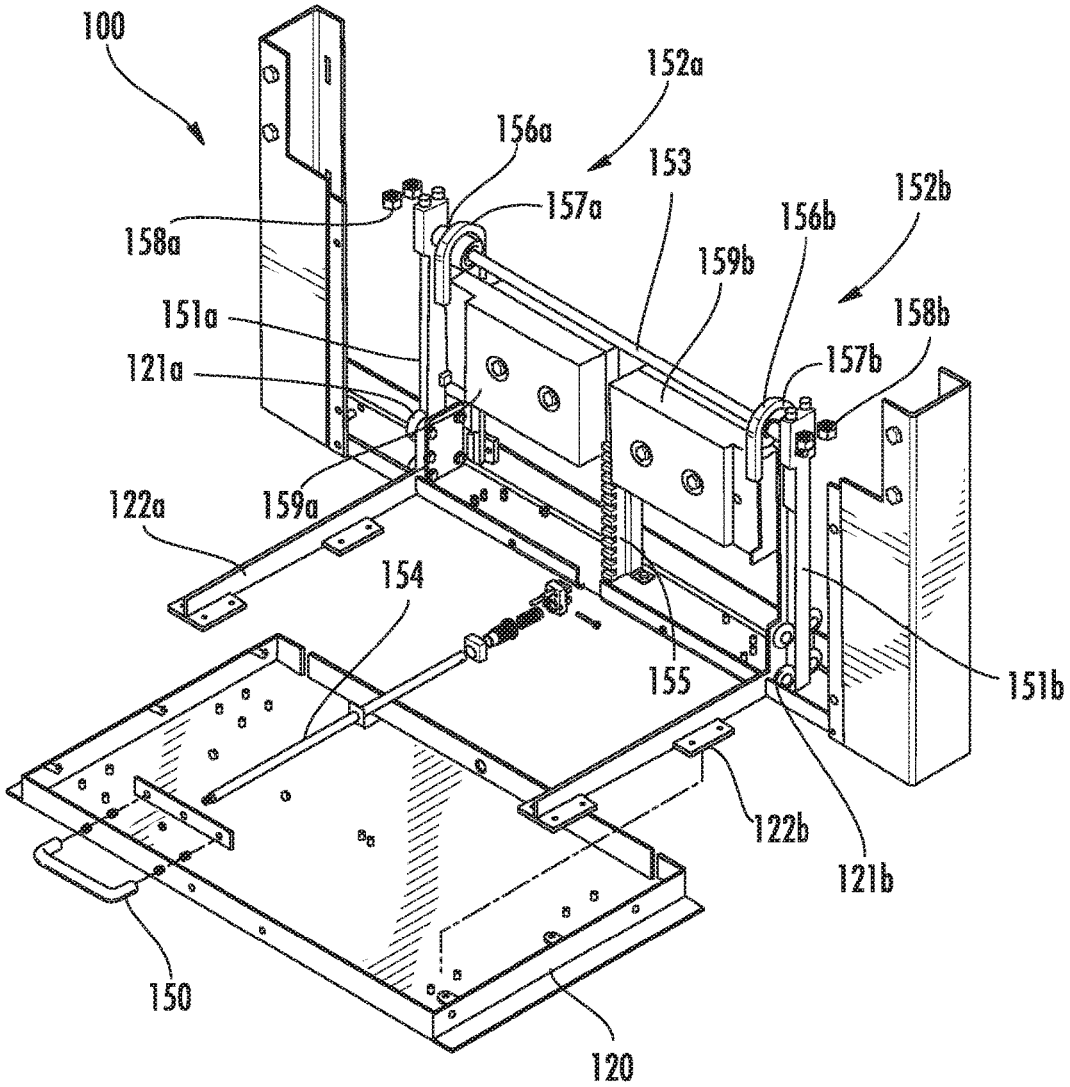
FIGS. 3A-3B illustrate an example of internal components of a cooking unit of FIGS. 1A-1B.
Figure 3B:
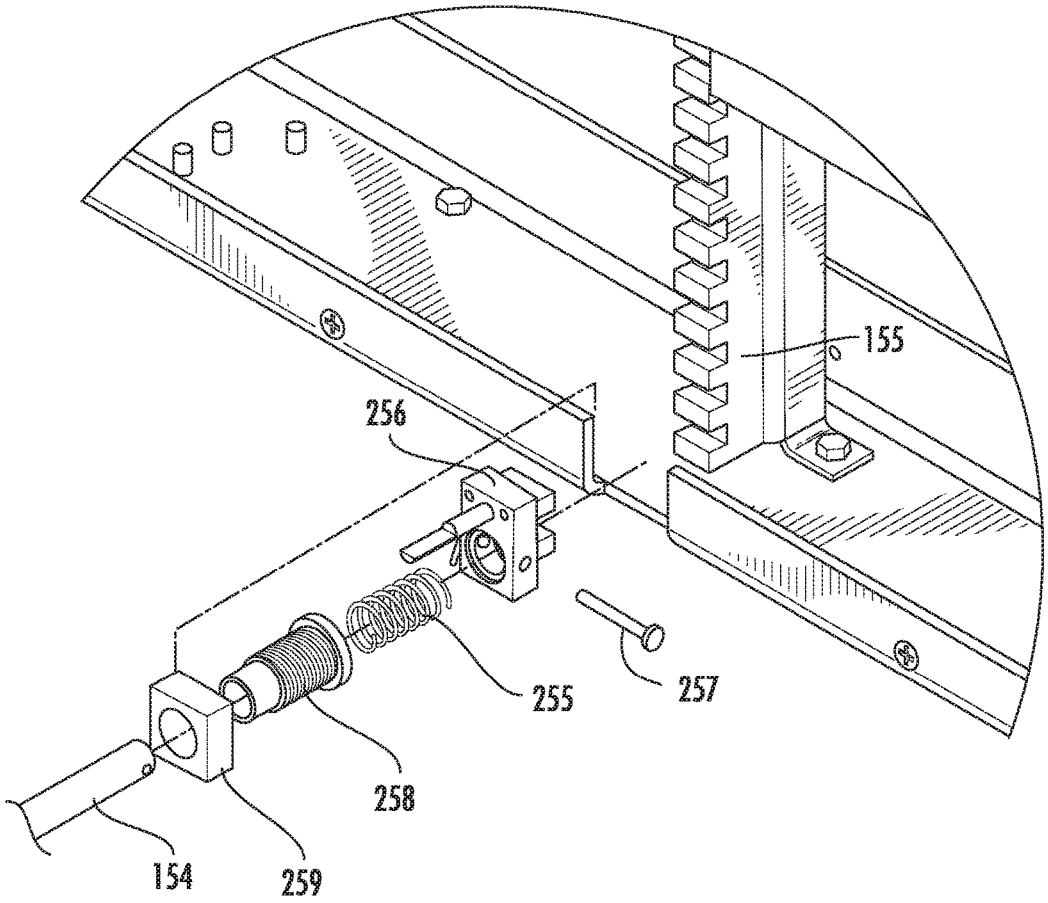

The rear housing 140 may have any shape. For example, the rear housing 140 may be a flat panel (or board). In such an example, the front side (or face) of the flat panel (or board) may be shaped as a rectangle, a square, a circle, an irregular shape, any other shape, or any combination of the preceding. As another example, the rear housing 140 may not be flat. Instead, the rear housing 140 may be (or have) a compartment with a cross-section (as is illustrated in FIG. 1B) that is shaped as a rectangle, a square, a circle, an irregular shape, any other shape, or any combination of the preceding. In such an example, the compartment portion of the rear housing 140 may contain one or more elements (or features) that may allow the support shelf 120 to be moved in a vertical direction (such as up and/or down), an example of which is illustrated in FIGS. 3A-3B. The rear housing 140 may also have any size. For example, the rear housing 140 may have a vertical height of approximately (i.e., +/−6 inches) 1 foot, approximately 2 feet, approximately 3 feet, approximately 4 feet, approximately 5 feet, approximately 6 feet, or approximately any other size. As another example, the rear housing 140 may have a lateral length of approximately (i.e., +/−6 inches) 1 foot, approximately 2 feet, approximately 3 feet, approximately 4 feet, approximately 5 feet, approximately 6 feet, or approximately any other size.

As illustrated, the cooking unit 100 further includes a heating chamber 110. The heating chamber 110 may be any apparatus that may generate heat. For example, the heating chamber 110 may be (or may have) a broiler, a heat lamp, a heater, an infrared (IR) emitting burner (such as a gas heated porous ceramic plate, for example), any other apparatus that may generate heat, or any combination of the preceding. In one example, a salamander and/or a cheese melter preferably includes an IR emitting burner positioned at the bottom of the heating chamber 110. The heating chamber 110 may further direct the heat in a direction. For example, the heating chamber 110 may direct the heat downward, so as to heat food (or any other item) located vertically below the heating chamber 110. In such an example, the heating chamber 110 may direct the heat downward toward the support shelf 120 and the sliding tray 130, so as to heat food (or any other item) positioned on the sliding tray 130. As another example, the heating chamber may direct heat (or be tilted) upward, if it is desirable to make a portion of the sliding tray 130 (such as the portion of the sliding tray 130 that is closer to the rear housing 140) hotter. In the case of the IR burner with a porous ceramic plate, the plate may, for example, be positioned generally parallel to and spaced apart from a vertical plane of the sliding tray 130 (discussed below).

The heating chamber 110 may generate heat in any manner. For example, the heating chamber 110 may a gas combustion chamber, an electric heating chamber, a wood-burning heating chamber, a charcoal-burning heating chamber, any other solid fuel-burning heating chamber, a chamber that generates heat using any other burnable or heat able substance, fuel, or energy source, any other chamber that may generate heat, or any combination of the preceding.

The heating chamber 110 may have any size. Also, the heating chamber 110 may have any shape. For example, the heating chamber 110 may have a cross-section shaped as a square, a rectangle, a circle, an oval, any other shape, or any combination of the preceding. As is illustrated in FIGS. 1A-1B, the heating chamber 110 has a cross-section shaped as a rectangle.

The heating chamber 110 may be made of (or constructed of) any material. For example, the heating chamber 110 may be made of steel, stainless steel, aluminum, iron, brass, titanium, any other metal or metal alloy (including coated, plated or clad metals), any other heat resistant material, or any combination of the preceding.

The heating chamber 110 may be coupled to the rear housing 140, as is illustrated in FIGS. 1A-1B. The heating chamber 110 may be coupled to the rear housing 140 in any manner. For example, the heating chamber 110 may be bolted to the rear housing 140, screwed to the rear housing 140, riveted to the rear housing 140, clipped or snapped into the rear housing 140, welded to the rear housing 140, formed integral with the rear housing 140, coupled to the rear housing 140 in any other manner, or any combination of the preceding. Any portion of the heating chamber 110 may be coupled to the rear housing 140. For example, as is illustrated, only the rear end of the heating chamber 110 (or a portion of the rear end of the heating chamber 110) may be coupled to the rear housing 140 (i.e., in a cantilever formation). In such an example, the support for the weight of the heating chamber 110 may be provided through this coupling. The heating chamber 110 may be coupled to any portion of the rear housing 140. For example, the heating chamber 110 may be coupled to a front face of the rear housing 140, a rear face of the rear housing 140, any other portion of the rear housing 140, or any combination of the preceding. As illustrated, the heating chamber 110 is coupled to the front face of the rear housing 140. Additionally, the heating chamber 110 may be coupled to the rear housing 140 at any height of the rear housing 140 and/or at any lateral position of the rear housing 140.

The heating chamber 110 may be oriented in any manner that may allow the heating chamber 110 to generate and direct heat, so as to heat food (or any other item). For example, the heating chamber 110 may be oriented horizontally, vertically, or any angle in-between horizontal and vertical. As illustrated, the heating chamber 110 is oriented horizontally.

As illustrated, the cooking unit 100 further includes vertical tracks 151. A vertical track 151 may be any structure that may form a path, route, or track in the vertical direction. For example, the track 151 may be a groove, an opening, a ridge, a slot, any other structure that may form a path, route, or track in the vertical direction, or any combination of the preceding. The vertical track 151 may form a path in the vertical direction that may be used to move the support shelf 120 vertically along the vertical track 151.

The cooking unit 100 may have any number of vertical tracks 151. For example, the cooking unit 100 may have 1 vertical track 151, 2 vertical tracks 151, 3 vertical tracks 151, 4 vertical tracks 151, 5 vertical tracks 151, or any other number of vertical tracks 151. As is illustrated in FIG. 1A, the cooking unit 100 has 2 vertical tracks 151 (i.e., vertical track 151*a* (not shown) and vertical track 151*b*). Furthermore, the vertical track 151 may have any shape and/or size. For example, the vertical track 151 may have a length that extends from approximately (i.e., +/−2 inches) the bottom of the rear housing 140 to approximately the vertical position at which the heating chamber 110 is coupled to the rear housing 140. As another example, the vertical track 151 may have a length of approximately (i.e., +/−6 inches) 1 foot to approximately 5 feet. The vertical track 151 may be made of (or constructed of) any material. For example, the vertical track 151 may be made of steel, stainless steel, aluminum, iron, brass, titanium, any other metal or metal alloy (including coated, plated or clad metals), refractory materials (such as cement, clay, brick, laminates), any other heat resistant material, or any combination of the preceding.

The vertical track 151 may be coupled to the rear housing 140. The vertical track 151 may be coupled to the rear housing 140 in any manner. For example, the vertical track 151 may be bolted to the rear housing 140, screwed to the rear housing 140, riveted to the rear housing 140, clipped or snapped into the rear housing 140, welded to the rear housing 140, formed integral with the rear housing 140, formed in the rear housing 140, coupled to the rear housing 140 in any other manner, or any combination of the preceding. The vertical track 151 may be coupled to any portion of the rear housing 140. For example, the vertical track 151 may be coupled to a front face of the rear housing 140, a rear face of the rear housing 140, in-between the front face of the rear housing 140 and the rear face of the rear housing 140, any other portion of the rear housing 140, or any combination of the preceding. As illustrated, the vertical tracks 151 are coupled inside the compartment portion of the rear housing 151, in-between the front face of the rear housing 140 and the rear face of the rear housing 140. The vertical track 151 may be coupled to the rear housing 140 at any height of the rear housing 140. For example, the vertical track 151 may be coupled to the rear housing 140 at any height vertically below the heating chamber 110. The vertical track 151 may further be coupled to the rear housing 140 at any lateral position of the rear housing 140.

As illustrated, the cooking unit 100 further includes a support shelf 120. A support shelf 120 may be any structure that may support sliding tray 130. For example, the support shelf 120 may be a slab, a panel, a board, a sheet, a shelf, one or more bars, one or more rods, one or more pipes, any other structure that may support sliding tray 130, or any combination of the preceding. The support shelf 120 may be moved vertically along the vertical tracks 151. For example, the support shelf 120 may be moved upward toward the heating chamber 110, or downward away from the heating chamber 110. The support shelf 120 may be moved vertically along the vertical tracks 151 in any manner. For example, the support shelf 120 may be manually moved (such as by a user of cooking unit 120 applying force to the support shelf 120), mechanically moved (such as by one or more motors, gears, and/or springs), magnetically moved, moved in any other manner, or any combination of the preceding. An example of elements (or features) that may allow the support shelf 120 to be moved in a vertical direction (such as up and/or down) is discussed below with regard to FIGS. 3A-3B.

The support shelf 120 may be moved vertically along the vertical tracks 151 for any distance. For example, the support shelf 120 may be moved along the vertical tracks 151 from approximately (i.e., +/−2 inches) the bottom of the rear housing 140 to approximately the vertical position at which the heating chamber 110 is coupled to the rear housing 140. As another example, the support shelf 120 may be moved along the vertical tracks 151 for a distance of approximately (i.e., +/−6 inches) 1 foot to approximately 5 feet. By moving the support shelf 120 vertically along the vertical tracks 151, food (or any other items) positioned on the sliding tray 130 (and supported by the support shelf 120) may be moved toward and/or away from the heating chamber 110. Such movement may increase and/or decrease the amount of heat (or temperature) that the food (or other item) is subjected to. Additionally, such movement may also allow the user of the cooking unit 100 additional space to work in. For example, by lowering the support shelf (and the sliding tray 130 supported by the support shelf 120), the user may have additional space to manipulate the food positioned on the sliding tray 130. As another example, by raising the support shelf 120 (and the sliding tray 130 supported by the support shelf 120), the user may have additional space underneath the support shelf 120 to perform other work. In such an example, another kitchen feature (such an oven or preparation table) may be positioned underneath the support shelf 120, and raising the support shelf 120 may increase the amount of workspace underneath the support shelf 120.

The support shelf 120 may have any size. For example, the support shelf 120 may have a lateral length of approximately (i.e., +/−6 inches) 1 foot to approximately 5 feet. As another example, the support shelf 120 may have a depth of approximately (i.e., +/−6 inches) 1 foot to approximately 4 feet. The support shelf 120 may further have any shape. For example, the support shelf 120 may have a cross-section shaped as a square, a rectangle, a circle, an oval, any other shape, or any combination of the preceding. As is illustrated in FIGS. 1A-1B, the support shelf 120 has a cross-section shaped as a rectangle. The support shelf 120 may be made of (or constructed of) any material. For example, the support shelf 120 may be made of steel, stainless steel, aluminum, iron, brass, titanium, any other metal or metal alloy (including coated, plated or clad metals), any other material, or any combination of the preceding.

The support shelf 120 may be coupled to the vertical tracks 151. The support shelf 120 may be coupled to the vertical tracks 151 in any moveable manner. For example, the support shelf 120 may include one or more wheels that may be inserted into the vertical tracks 151, as is illustrated in FIG. 3A. As another example, the support shelf 120 may include one or more hooks, rods, brackets and/or connectors that may be coupled to the vertical tracks 151 by a device that moves (automatically or manually) along the vertical tracks 151.

Any portion of the support shelf 120 may be coupled to the rear housing 140. For example, only the rear end of the support shelf 120 (or a portion of the rear end of the heating chamber 110) may be coupled to the rear housing 140 (i.e., in a cantilever formation). As another example, only the rear portion of side surfaces of the heating chamber 110 may be coupled to the rear housing 140, an example of which is illustrated in FIG. 3A. In such examples, the support for the weight of the heating chamber 110 may be provided through these example couplings. The support shelf 120 may be coupled to the vertical tracks 151 at any height of the rear housing 140. For example, the support shelf 120 may be coupled to the vertical tracks 151 at a height vertically below the heating chamber 110. As such, the support shelf 120 may be positioned underneath the heating chamber 110.

As illustrated, the cooking unit 100 further includes a sliding tray 130. A sliding tray 130 may be any structure that may be used to support food (or other items) to be heated (or cooked) by the heating chamber 110. For example, the sliding tray 130 may be a tray, a container, a slab, a panel, a board, a sheet, a shelf, one or more bars, one or more rods, one or more pipes, any other structure that may be used to support food (or other items) to be heated (or cooked) by the heating chamber 110, or any combination of the preceding. The sliding tray 130 may be moved horizontally with respect to the rear housing 140 (and/or the support shelf 120). For example, the sliding tray 130 may be moved horizontally away from the rear housing 140 (and/or the support shelf 120). Furthermore, the sliding tray 130 may be moved horizontally toward the rear housing 140 (and/or the support shelf 120). The sliding tray 130 may be moved horizontally in any manner. For example, the sliding tray 130 may be manually moved (such as by a user of cooking unit 100 applying force to the sliding tray 130), mechanically moved (such as by one or more motors, gears, and/or springs), magnetically moved, moved in any other manner, or any combination of the preceding. In one example, the sliding tray 130 is preferably manually moved horizontally.

The sliding tray 130 may be moved horizontally for any distance. For example, the sliding tray 130 may be moved horizontally for a distance of approximately (i.e., +/−6 inches) 1 foot to approximately 4 feet. As another example, the sliding tray 130 may be moved horizontally for a distance of between 0 inches to 14 inches (or more). By moving the sliding tray 130 horizontally, food (or any other items) positioned on the sliding tray 130 may be moved away from a position directly underneath the heating chamber 110. Such movement may decrease the amount of heat (or temperature) that the food (or other item) is subjected to. Additionally, such movement may also allow the user of the cooking unit 100 to add and/or remove food (or any other items) from the sliding tray 130 without the user being subjected to direct heat from the heating chamber 110. As such, the user may be less likely to be burned by the heating chamber 110. In one example, the sliding tray 130 is preferably moved far enough away from underneath the heating chamber 110 to facilitate a safer way to inspect and/or remove food. As this may depend on the nature of what is being cooked or prepared, it is more preferable for the sliding tray 130 to be moved completely out from underneath the heating chamber 110, in one example.

The sliding tray 130 may be moved horizontally at any time with respect to the vertical movement of the support shelf 120, and vice versa. For example, the sliding tray 130 may be moved horizontally toward (or away from) the rear housing 140 while the support shelf 120 is at a maximum vertical position, a minimum vertical position, any other vertical position in-between the maximum and minimum vertical position, and/or while the support shelf 120 is being moved vertically. As another example, the support shelf 120 may be moved vertically toward (or away from) the heating chamber 110 while the sliding tray 130 is at a maximum forward horizontal position with respect to the rear housing 140, a minimum forward horizontal position with respect to the rear housing 140, any other horizontal position in-between the maximum and minimum forward horizontal position with respect to the rear housing 140, and/or while the sliding tray 130 is being moved horizontally. In some examples, the sliding tray 130 may not be moved horizontally toward (or way from) the rear housing 140 while the support shelf 120 is being moved vertically, and/or the support shelf 120 may not be moved vertically toward (or away from) the heating chamber 110 while the sliding tray 130 is being moved horizontally.

The sliding tray 130 may have any size. For example, the sliding tray 130 may have a lateral length of approximately (i.e., +/−6 inches) 1 foot to approximately 5 feet. As another example, the sliding tray 130 may have a depth of approximately (i.e., +/−6 inches) 1 foot to approximately 4 feet. The sliding tray 130 may be wider than, narrower than, or the same size as the support shelf 120. The sliding tray 130 may further have any shape. For example, the sliding tray 130 may have a cross-section shaped as a square, a rectangle, a circle, an oval, any other shape, or any combination of the preceding. As is illustrated in FIGS. 1A-1B, the sliding tray 130 has a cross-section shaped as a rectangle. The sliding tray 130 may be made of (or constructed of) any material. For example, the sliding tray 130 may be made of steel, stainless steel, aluminum, iron, brass, titanium, any other metal or metal alloy (including coated, plated or clad metals), refractory materials (such as cement, clay, brick, laminates), any other heat resistant material, or any combination of the preceding.

The sliding tray 130 may be coupled to the support shelf 120 in a moveable manner. This may allow the sliding tray 130 to move horizontally toward and/or away from the rear housing 14 (such as move horizontally at a 90 degree angle to a vertical surface (or face) of the rear housing 140). It may further allow the sliding tray 130 to pivot (or rotate) with respect to the support shelf 120, allowing, for example, the sliding tray 130 to be rotated toward a user (such as a user who is not standing directly in front of the cooking unit 100). The sliding tray 130 may be coupled to the support shelf 120 in any moveable manner. For example, the sliding tray 130 may include one or more wheels, rails, tracks, hinges, movable items, moveable engaging features (such as moveable brackets), rotatable items, rotatable engaging features, any other movable structure, any other rotatable structure, or any combination of the preceding. These moveable (and/or rotatable) features of the sliding tray 130 may be inserted into (or work in combination with) one or more grooves, slots, brackets, tracks, rails, hinges, or complementary moveable (and/or rotatable) structures included on (or formed in) the support shelf 120, allowing the sliding tray 130 to move horizontally with respect to the rear housing 140 and/or allowing the sliding tray 130 to rotate with respect to the support shelf 120. The grooves, slots, brackets, tracks, rails, hinges, or complementary moveable (and/or rotatable) structures may be included on (or formed in) the top surface of the support shelf 130, the bottom surface of the support shelf 130, or the side surfaces of the support shelf 130. These grooves, slots, brackets, tracks, rails, hinges, or complementary moveable (and/or rotatable) structures included on (or formed in) in the support shelf 130 may guide the sliding tray along the support shelf 130 in a horizontal manner and/or in a rotatable manner. As another example, the sliding tray 130 may include one or more hooks, rods, brackets and/or connectors that may be coupled to the support shelf 120 by a device that moves (automatically or manually) along the support shelf 120.

The sliding tray 130 may be positioned at any location with respect to the support shelf 120. For example, the sliding tray 130 may be positioned above the support shelf 120, below the support shelf 120, to either lateral side of the support shelf 120, any other location with respect to the support shelf 120, or any combination of the preceding. In one example, the sliding tray 130 is preferably positioned above the support shelf 120 (so as to be closer to the heating chamber 110). The sliding tray 130 may be positioned at any angle with respect to the support shelf 120. For example, the sliding tray 130 may be positioned parallel to the support shelf 120, as is illustrated in FIG. 1A-1B. Furthermore, the horizontal movement of the sliding tray 130 may be at any angle with respect to the support shelf 120. For example, all (or a portion) of the horizontal movement of the sliding tray 130 may be parallel to the support shelf 120.

The sliding tray 130 may further include various components, features, or parts. For example, as is illustrated, the sliding tray 130 includes a top surface 138, a catch tray 136, and a handle 135. The top surface 138 may be positioned on top of the sliding tray 130, and may directly support food (or any other items). The top surface 138 may include any surface for supporting (and/or cooking) food, such as a flat surface, a rack, a grate (or grill surface), any other surface for supporting (and/or cooking) food, or any combination of the preceding. The catch tray 136 may be positioned below the top surface 138, and may catch (and/or collect) portions of the food that may drip during the heating (and/or cooking) process. The handle 135 may be positioned on a front surface of the sliding tray 130. The handle 135 may have any size, shape, and/or configuration for allowing a user to grasp the handle 135. The handle 135 may be grasped (or otherwise be handled) by a user in order to move the support shelf 120 (and sliding tray 130) vertically along the vertical tracks 151, to move the sliding tray 130 horizontally, to rotate (or pivot) the sliding tray 130, or any combination of the preceding.

As illustrated in FIG. 1B, the cooking unit 100 further includes an actuator 150. An actuator 150 may be any device or mechanism that may lock and unlock the support shelf 120. When the support shelf 120 is locked, the support shelf 120 may be prevented from being moved vertically along the vertical tracks 151. As such, the support shelf 120 may remain in the same vertical position until the support shelf 120 is unlocked. Alternatively, when the support shelf 120 is unlocked, the support shelf 120 may be moved vertically along the vertical tracks 151. As such, the vertical position of the support shelf 120 may be changed.

The actuator 150 may lock and unlock the support shelf 120 in any manner. For example, the actuator 150 may be (or may be coupled) to a mechanism that blocks the vertical tracks 151, a gear-based mechanism that prevents a motor from being put into gear to move the support shelf 120, a motor-based mechanism that starts and stops a motor that may move the support shelf 120, a mechanism that may include protrusions that may be inserted into a flat gear to prevent the support shelf 120 from moving along the vertical tracks 151, a magnetic-based system that may use magnetic forces to temporarily lock the support shelf 120 in a vertical position, any other mechanism and/or system for locking and unlocking the support shelf 120, or any combination of the preceding. FIGS. 3A-3B provide further details regarding one example for locking and unlocking the support shelf 120.

The actuator 150 may unlock the support shelf 120 by being engaged. Additionally, the actuator 150 may be engaged in any manner. For example, the actuator 150 may be engaged by moving the actuator 150 (e.g., moving the actuator 150 using a finger), pulling the actuator 150 forward (or out), pushing the actuator 150 backward (or in), depressing the actuator 150 (e.g., depressing a button), twisting the actuator 150, moving the actuator 150 laterally (e.g., to the left or right), moving the actuator 150 vertically (e.g., up or down), grasping the actuator 150 (e.g., using a single hand to co-grasp both the handle 135 and the actuator 150 by placing the palm of the hand on or around the handle 135 and placing one or more fingers on or through the actuator 150 in a grasping motion), any other manner of engaging the actuator 150, or any combination of the preceding. The actuator 150 may lock the support shelf 120 by being unengaged (or not being engaged). The actuator 150 may be unengaged in any manner. For example, the actuator 150 may be unengaged by reversing the motion that engaged the actuator 150, releasing the actuator 150 from being engaged (which may cause the actuator 150 to move back to an unengaged position), any other manner of unengaging the actuator 150, or any combination of the preceding. The actuator 150 may rest in a unengaged position, and may only leave the unengaged position when the actuator 150 is actively engaged. In such an example, the support shelf 120 may rest in a locked position, and may only be unlocked (for moving the support shelf 120 vertically along the vertical tracks 151) when the actuator is actively engaged. Furthermore, although the actuator 150 has been described as unlocking the support shelf 120 when engaged and locking the support shelf 120 when unengaged, the actuator 150 may alternatively unlock the support shelf 120 when unengaged and lock the support shelf 120 when engaged.

The actuator 150 may have any size. For example, the actuator 150 may have a length that is longer than, equal to, or shorter than the handle 135. In one example, it is preferable that the actuator 150 is shorter than the handle 135. This may allow a user to grip the handle 135 in a location that is distal from the actuator 150 so as to reduce the chances of accidentally engaging the actuator 150 when such engagement is undesirable (such as when the sliding tray 130 is being moved horizontally, but not vertically, for example) or so as to reduce the chances of accidentally grasping the actuator 150 rather than the handle 135. As another example, the actuator 150 may have a diameter that is larger than, equal to, or smaller than the handle 135. In one example, it is preferable that the actuator 150 has a diameter that is smaller than the handle 135 so as to reduce the chances of accidentally grasping the actuator 150 rather than the handle 135, for example.

The actuator 150 may have any shape. For example, the actuator 150 may be shaped as (or may be) a button, a pull lever, a pull handle, a switch, a latch, any other shape, or any combination of the preceding.

As another example, the actuator 150 may have a T-shape. The actuator 150 may have a cross section with the same shape as the cross section of the handle 135 or may have a cross section with a different shape. In one example, it is preferable that the actuator 150 is a pull handle with a narrow bar-like cross section, while the handle 135 has a round cross-section, so as to reduce the chances of accidentally grasping the actuator 150 rather than the handle 135, for example.

The actuator 150 may be made of (or constructed of) any material. For example, the actuator 150 may be made of steel, stainless steel, aluminum, iron, brass, titanium, any other metal or metal alloy (including coated, plated or clad metals), any other material, or any combination of the preceding. Furthermore, the actuator 150 may optionally have a plastic, rubber, or laminate grip that covers all or a portion of the actuator 150.

The actuator 150 may be coupled to the support shelf 120 and/or the sliding tray 130. For example, the actuator 150 may be positioned within the support shelf 120, positioned within the sliding tray 130, coupled to a surface (such as a bottom surface) of the support shelf 120, coupled to a surface (such as a front surface) of the sliding tray 130, coupled to the handle 135 of the sliding tray 130, coupled to the support shelf 120 and/or the sliding tray 130 in any other manner, or any combination of the preceding. As is illustrated in FIGS. 1A-1B, the actuator 150 is coupled to the support shelf 120. In such an example, the actuator 150 may not move horizontally with the sliding tray 130, and may be hidden underneath the sliding tray 130 when the sliding tray 130 is moved horizontally away from the rear housing 140 (and/or the support shelf 120) and/or when the sliding tray 130 is at a maximum forward horizontal position with respect to the rear housing 140 (and/or the support shelf 120), as is illustrated in FIG. 1A.

The actuator 150 may be positioned adjacent (or otherwise in a close proximity) to the handle 135 of the sliding tray 130. Such a positioning may allow both the handle 135 of the sliding tray 130 to be grasped and the actuator 150 to be engaged by a user using only a single hand. For example, the user may use the single hand to grasp the handle 135, and may use the same hand to pull the actuator 150 forward toward the handle 135 (thereby engaging the actuator 150). Such an engagement may occur after the hand is already grasping the handle 135, immediately before the hand grasps the handle 135, or at substantially the same time as the hand grasping the handle 135 (i.e., both actions occur during the same motion of the hand).

The actuator 150 may be positioned at any location adjacent the handle 135 of the sliding tray 130. A location adjacent to the handle 135 may refer to any location that allows both the handle 135 of the sliding tray 130 to be grasped and the actuator 150 to be engaged by a user using only a single hand. As is discussed above, such an engagement may occur after the hand is already grasping the handle 135, immediately before the hand grasps the handle 135, or at substantially the same time as the hand grasping the handle 135. Examples of a location adjacent to the handle 135 include the actuator 150 being located on (or integrated with) the handle 135 (e.g., the actuator may be a button or latch positioned on the handle 135), above the handle 135 by less than approximately (+/−0.5 inches) 6 inches, above the handle 135 by approximately 3 inches, above the handle 135 by less than approximately 2 inches, above the handle 135 by less than approximately 1 inch, above the handle 135 by a range of approximately 6 inches to approximately 1 inch, below the handle 135 by less than approximately 6 inches, below the handle 135 by less than approximately 3 inches, below the handle 135 by less than approximately 2 inches, below the handle 135 by less than approximately 1 inch, below the handle 135 by a range of approximately 6 inches to approximately 1 inch, to the left of the handle 135 by less than approximately 6 inches, to the left of the handle 135 by less than approximately 3 inches, to the left of the handle 135 by less than approximately 2 inches, to the left of the handle 135 by less than approximately 1 inch, to the left of the handle 135 by a range of approximately 6 inches to approximately 1 inch, to the right of the handle 135 by less than approximately 6 inches, to the right of the handle 135 by less than approximately 3 inches, to the right of the handle 135 by less than approximately 2 inches, to the right of the handle 135 by less than approximately 1 inch, to the right of the handle 135 by a range of approximately 6 inches to approximately 1 inch, in a space in-between a rear surface of the handle 135 and a front surface of the sliding tray 135 and located less than approximately 6 inches from the rear surface of the handle 135, in a space in-between a rear surface of the handle 135 and a front surface of the sliding tray 135 and located less than approximately 3 inches from the rear surface of the handle 135, in a space in-between a rear surface of the handle 135 and a front surface of the sliding tray 135 and located less than approximately 2 inches from the rear surface of the handle 135, in a space in-between a rear surface of the handle 135 and a front surface of the sliding tray 135 and located less than approximately 1 inch from the rear surface of the handle 135, in a space in-between a rear surface of the handle 135 and a front surface of the sliding tray 135 and located within a range of approximately 6 inches to approximately 1 inch, within a length of an adult sized hand from the handle 135, any other location adjacent the handle 135, or any combination of the preceding. As illustrated, the actuator is located in the space in-between the rear surface of the handle 135 and the front surface of the sliding tray 135. This position may allow the user 135 to grasp both the actuator 150 and the handle 135 in the same squeezing motion, thereby causing both the handle 135 to be grasped and the actuator 150 to be engaged (by pulling the actuator 150 forward toward the handle 135) by the same hand of the user.

By positioning the actuator 150 adjacent the handle 135 of the sliding tray 130 (as is discussed above), the user may simultaneously unlock the support shelf 120 and also lift and/or lower the support shelf 120 using the same hand. In such an example, such lifting and/or lowering of the support shelf 120 may be caused by the user using the same hand to apply vertical pressure to the handle 135 of the sliding tray 130 (while the actuator 150 is engaged). Furthermore, once the support shelf 120 is at a desired vertical position, the user may use the same hand to unengage the actuator 150 (such as by releasing the actuator 150), causing the support shelf 120 to be locked in that vertical position. As such, the vertical positioning of the support shelf 120 may be adjusted using only one hand, which may allow the user to adjust the vertical position of the support shelf 120 while also utilizing a second hand to, for example, hold food to be cooked, wear an oven mitt that may be used to prevent the user from being burned, or hold a towel, tray, plate, or utensil.

Figure 4A:
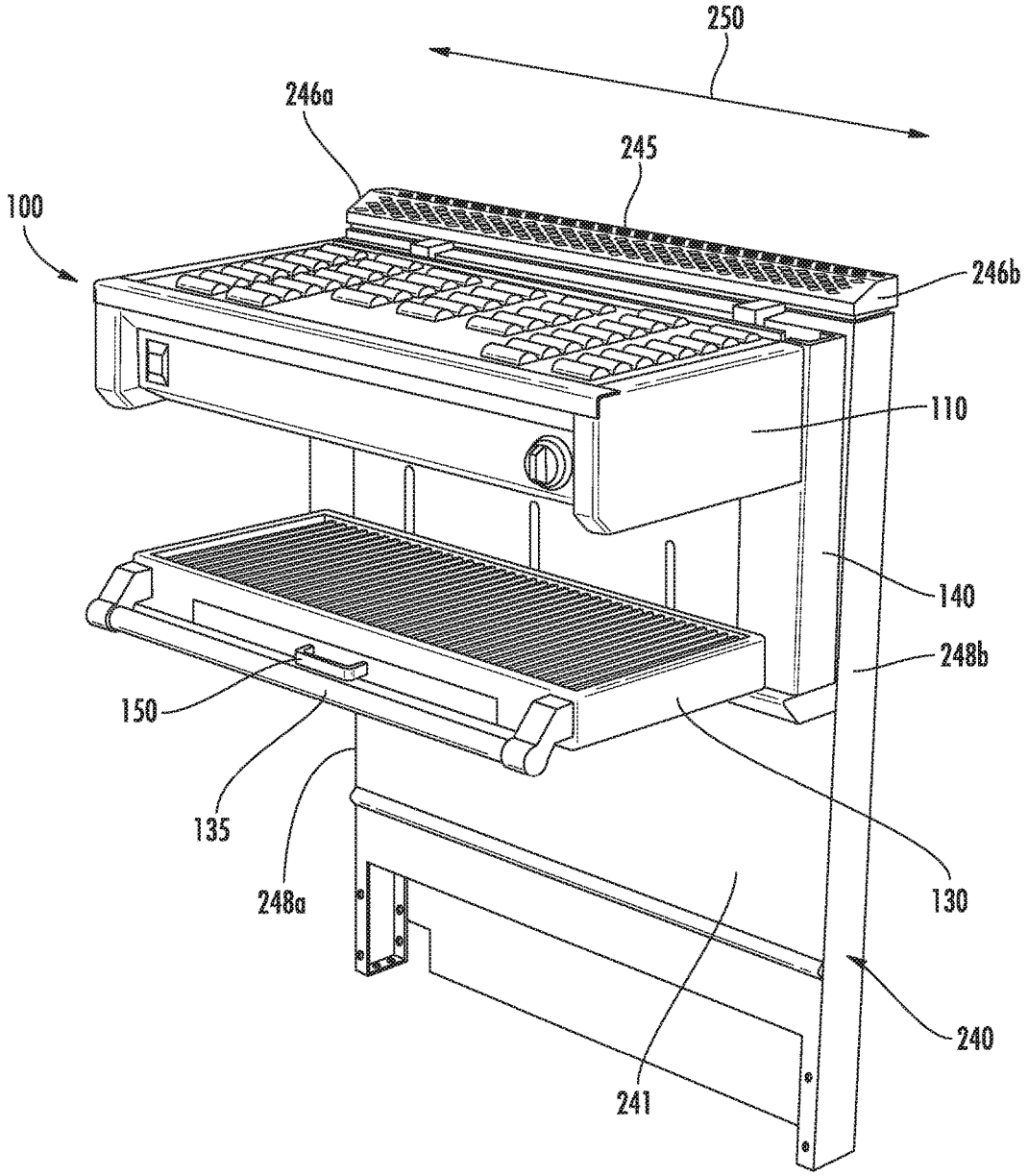
FIGS. 4A-4B illustrate an example of the cooking unit of FIGS. 1A-1B coupled to a vent flue.

In some examples, the actuator 150 may not always be positioned adjacent (or otherwise in a close proximity) to the handle 135 of the sliding tray 130. For example, as is illustrated in FIGS. 1A-1B, the actuator 150 may be coupled to the support shelf 120. In such an example, the actuator 150 may not move horizontally with the sliding tray 130 (and the handle 135), which may cause the handle 135 of the sliding tray 130 to move away from actuator 150 when the sliding tray 130 is moved horizontally away from the rear housing 140, and may further cause the handle 135 of the sliding tray 130 to move toward the actuator 150 when the sliding tray 130 is moved horizontally toward the rear housing 140. As such, the actuator 150 may be positioned adjacent (or otherwise in a close proximity) to the handle 135 when the sliding tray 130 is at (or near) a minimum forward horizontal position with respect to the rear housing 140 (and/or the support shelf 120), as is illustrated in FIGS. 1B and 4A. Furthermore, the actuator 150 may not be positioned adjacent (or otherwise in a close proximity) to the handle 135 when the sliding tray 130 is at a maximum forward horizontal position with respect to the rear housing 140 (and/or the support shelf 120), as is illustrated in FIG. 1A.

As is illustrated, the cooking unit 100 further includes brackets 190. A bracket 190 may be any device for coupling (or otherwise connecting) the cooking unit 100 to a structure. For example, a bracket 190 may be a bracket (such as an inverted U bracket, an inverted V bracket, or any other shaped bracket), a clip, a hook, a latching device, any other device for coupling (or otherwise connecting) the cooking unit 100 to a structure, or any combination of the preceding. As illustrated, the bracket 190 is an inverted U shaped bracket.

The bracket 190 may have multiple parts. For example, as illustrated, the bracket 190 includes a top portion 191 coupled in-between a rear leg 192 and a front leg 193. The top portion 191, the rear leg 192, and the front leg 193 may have any shape. For example, one or more (or all) of the top portion 191, the rear leg 192, and the front leg 193 may have a side or a cross-section that is shaped as a rectangle, a square, an irregular shape, any other shape, or any combination of the preceding. The top portion 191, the rear leg 192, and the front leg 193 may also have any size. For example, the top portion 191 may have a length within a range of approximately (i.e., +/−0.5 inches) 1 inch to approximately 6 inches, the rear leg 192 may have a length within a range of approximately 2 inches to approximately 12 inches, and the front leg 193 may have a length within a range of approximately 2 inches to approximately 48 inches. As another example, the front leg 193 may have a length that is equal to the height of the cooking unit 100, while the top portion 191 and the rear leg 192 may have lengths that are less than the length of the front leg 193. The length of the top portion 191 may form a gap 194 in-between the rear leg 192 and the front leg 193, as is illustrated in FIGS. 1A-1B. The gap 194 may allow the bracket 190 to be inserted into a structure (such as into a vent flue of a kitchen, as is illustrated in FIGS. 4A-5B).

The top portion 191 may be coupled to the rear leg 192 and the front leg 193 in any manner. For example, the top portion 191 may be bolted to the rear leg 192 and the front leg 193, screwed to the rear leg 192 and the front leg 193, riveted to the rear leg 192 and the front leg 193, clipped or snapped into the rear leg 192 and the front leg 193, welded to the rear leg 192 and the front leg 193, formed integral with the rear leg 192 and the front leg 193, coupled to the rear leg 192 and the front leg 193 in any other manner, or any combination of the preceding.

The bracket 190 may be coupled to rear housing 140. The bracket 190 may be coupled to any portion of the rear housing 140. For example, the front leg 193 may be coupled to a rear face (or surface) of the rear housing 140. The front leg 193 may be coupled to the rear face of the rear housing 140 in any manner. For example, the front leg 193 may be bolted to the rear face of the rear housing 140, screwed to the rear face of the rear housing 140, nailed to the rear face of the rear housing 140, clipped or snapped into the rear face of the rear housing 140, welded to the rear face of the rear housing 140, formed integral with the rear face of the rear housing 140, coupled to the rear face of the rear housing 140 in any other manner, or any combination of the preceding.

The cooking unit 100 may include any number of brackets 190. For example, the cooking unit 100 may include 1 bracket 190, 2 brackets 190, 3 brackets 190, 4 brackets 190, 10 brackets 190, 20 brackets 190, or any other number of brackets 190. As illustrated, the cooking unit 100 includes 2 brackets 190 (bracket 190*a* and bracket 190*b*). The brackets 190 may be made of (or constructed of) any material. For example, the bracket 190 may be made of steel (such as heavy duty, thick gauge, high grade, and fully welded steel bars), stainless steel, aluminum, iron, brass, titanium, any other metal or metal alloy including coated, plated or clad metals, any other material, or any combination of the preceding. Additionally, the bracket 190 may be hollow, or it may be solid.

The brackets 190 may couple the cooking unit 100 to any structure. For example, the brackets 190 may couple the cooking unit 100 to a structure associated with a kitchen, such as a kitchen vent flue, a kitchen table, a kitchen cabinet, a kitchen door, any other structure associated with a kitchen, or any combination of the preceding. As another example, the brackets 190 may couple the cooking unit 100 to any other structure, whether or not the structure is associated with a kitchen. Additionally, the brackets 190 may allow the cooking unit 100 to be moved even after the cooking unit 100 is coupled to the structure. For example, by providing a secure coupling (without the use of bolts or any other permanent-type coupling), the brackets 190 may allow the cooking unit 100 to be moved. In such an example, cooking unit 100 may be moved laterally along the structure without uncoupling the cooking unit 100 from the structure (as is illustrated by arrow 250 of FIGS. 4A and 5A). Furthermore, the cooking unit 100 may also be more easily uncoupled from the structure and moved to an entirely different structure (or to another section of the same structure).

Although the cooking unit 100 has been described above as including brackets 190 for coupling the cooking unit 100 to a structure, the cooking unit 100 may include any other item or mechanism for coupling the cooking unit 100 to a structure. Additionally, the rear housing 140 itself may be coupled to a structure. The rear housing 140 may be coupled to a structure in any manner. For example, the rear housing 140 may be bolted to the structure, screwed to the structure, riveted to the structure, clipped or snapped into the structure, welded to the structure, formed integral with the structure, coupled to the structure in any other manner, or any combination of the preceding.

Figure 2A:
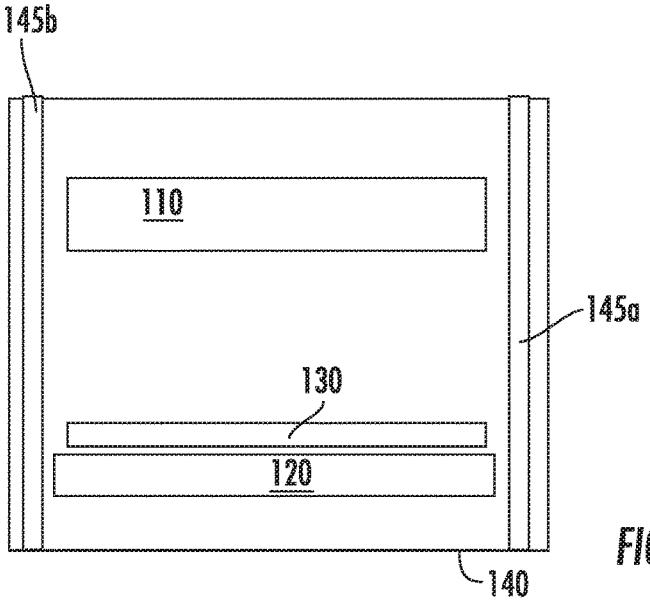
FIGS. 2A-2C illustrate another example cooking unit.
Figure 2B:
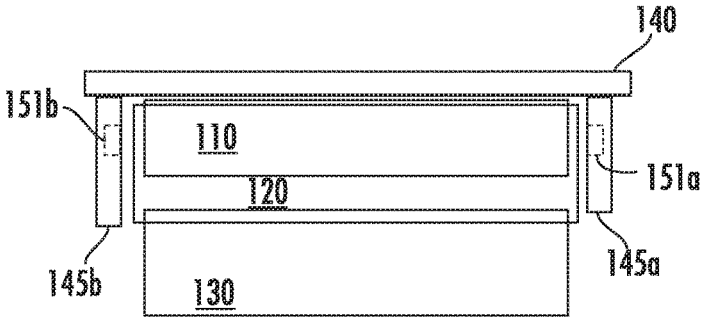
Figure 2C:
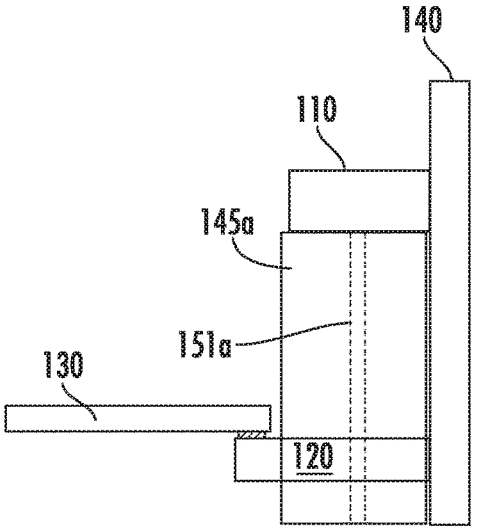

FIGS. 2A-2C illustrate another example cooking unit. In particular, FIG. 2A illustrates a front view of a block diagram of a cooking unit 100, FIG. 2B illustrates a top view of a block diagram of the cooking unit 100, and FIG. 2C illustrates a side view of a block diagram of the cooking unit 100. The cooking unit 100 of FIGS. 2A-2C may be substantially similar to the cooking unit 100 of FIGS. 1A-1B. However, the cooking unit 100 may further includes sides 145*a* and 145*b* coupled to opposing portions of the rear housing 140.

The side 145 may be any structure that may support one or more features of the cooking unit 100. For example, the side 145 may be a slab, a panel, a board, a sheet, one or more bars, one or more rods, one or more pipes, any other structure that may support one or more features of the cooking unit 100, or any combination of the preceding. As is illustrated, the sides 145 may support vertical tracks 151 of the cooking unit 100.

The side 145 may be made of (or constructed of) any material. For example, the side 145 may be made of steel, stainless steel, aluminum, iron, brass, titanium, any other metal or metal alloy (including coated, plated and clad metals), any other material that is sufficiently strong and stable while enduring long term exposure to heat, or any combination of the preceding. Additionally, the side 145 may be hollow, or it may be solid.

The side 145 may have any shape. For example, the rear housing 140 may be a flat panel (or board). In such an example, the front side (or face) of the flat panel (or board) may be shaped as a rectangle, a square, a circle, an irregular shape, any other shape, or any combination of the preceding. The side 145 may also have any size. For example, the side 145 may have a vertical height of approximately (i.e., +/−6 inches) 1 foot, approximately 2 feet, approximately 3 feet, approximately 4 feet, approximately 5 feet, approximately 6 feet, or approximately any other size. As another example, the side 145 may have a lateral length of approximately (i.e., +/−6 inches) 1 foot, approximately 2 feet, approximately 3 feet, approximately 4 feet, approximately 5 feet, approximately 6 feet, or approximately any other size.

The side 145 may be coupled to the rear housing 145. The side 145 may be coupled to any portion of the rear housing 145. For example, as is illustrated, the sides 145*a* and 145*b* are coupled to opposing portions of the front face (or surface) of the rear housing 145. The side 145 may be coupled to the rear housing 145 at any angle. As is illustrated, the side 145 is coupled at a 90 degree angle to the rear housing 145. The side 145 may be coupled to the rear housing 140 in any manner. For example, the side 145 may be bolted to the rear housing 140, screwed to the rear housing 140, riveted to the rear housing 140, clipped or snapped into the rear housing 140, welded to the rear housing 140, formed integral with the rear housing 140, coupled to the rear housing 140 in any other manner, or any combination of the preceding.

As is illustrated, the sides 145 may support vertical tracks 151 of the cooking unit 100. For example, the vertical tracks 151*a* and 151*b* may be coupled to the sides 145*a* and 145*b* (as opposed to being coupled directly to the rear housing 140, as is discussed above with regard to FIGS. 1A-1B). This may reduce the load on the rear housing 140. Furthermore, such a coupling may provide additional support to support shelf 120 and/or sliding tray 130. Although the vertical tracks 151 of FIGS. 2A-2C are coupled to the sides 145 (as opposed to being coupled directly to the rear housing), the support shelf 120 may still be moved vertically along the vertical tracks 151 in any manner. For example, the support shelf 120 may be manually moved (such as by a user of cooking unit 120 applying force to the support shelf 120), mechanically moved (such as by one or more motors, gears, and/or springs), magnetically moved, moved in any other manner, or any combination of the preceding. An example of elements (or features) that may allow the support shelf 120 to be moved in a vertical direction (such as up and/or down) is discussed below with regard to FIGS. 3A-3B.

FIGS. 3A-3B illustrate an example of internal components of the cooking unit of FIGS. 1A-1B. In particular, FIG. 3A illustrates an exploded front perspective view of a portion of the cooking unit 100; and FIG. 3B illustrates an enlarged view of a portion of FIG. 3A. The illustrated internal components of the cooking unit 100 may allow the support shelf 120 (and the sliding tray 130) to be moved vertically along the vertical tracks 151, and may further allow the support shelf 120 to be locked and unlocked.

As illustrated, the support shelf 120 includes opposing support arms 122 (such as horizontal brackets) that may couple support shelf 120 to the vertical tracks 151. A top surface (not shown) and a bottom surface of the support shelf 120 may be coupled to the support arms 122, thereby forming the support shelf 120. Furthermore, the support arms 122 may include wheels 121*a* and 121*b* (such as guide wheels). These wheels 121 may be inserted into the vertical tracks 151, thereby coupling the support shelf 120 to the vertical tracks 151.

The rear housing 140 may include one or more vertical flat gears 155. The vertical flat gear 155 may be positioned in any lateral location in (or on) the rear housing 140. For example, the vertical flat gear 155 may be positioned to the left of vertical track 151*a*, to the right of vertical track 151*b*, in-between vertical tracks 151*a* and 151*b*, in-between the counterweight pulleys 152 (discussed below), any other position, or any combination of the preceding.

The rear housing 140 may further include a pair of counterweight pulleys 152*a* and 152*b* that may couple the support arms 122 (and thus the support shelf 120) to a pair of counterweights 159*a* and 159*b*. This coupling may allow the counterweights 159 to balance all or a portion of the weight of the support shelf 120 (and sliding tray 130), thereby allowing the support shelf 120 to be moved vertically more easily. For example, as the support shelf 120 moves vertically upward, the balancing counterweights 159 may move vertically downward, counteracting the movement of the support shelf 120 and making it easier to manually move the support shelf 120 vertically upward. As another example, as the support shelf 120 moves vertically downward, the balancing counterweights 159 may move vertically upward, counteracting the movement of the support shelf 120 and making it easier to manually move the support shelf 120 vertically downward.

The counterweight pulleys 152 may be formed from roller chains 156*a* and 156*b* (such as bicycle-type chains) that engage sprockets 157*a* and 157*b* coupled to the opposing ends of a common bearing rod 153 (positioned behind a rear surface of the support shelf 120). The ends of the bearing rod 153 may be supported by radial bearings 158*a* and 158*b* at the top of each vertical track 151*a* and 151*b*. The sprockets 157 and bearing rod 153 may rotate as the roller chains 156 move. A first end of each roller chain 156 may be coupled to the rear surface of a support arm 122, and a second opposing end of each roller chain 156 may be coupled to a counterweight 159, thereby coupling the support arm 122 (and thus the support shelf 120) to the counterweights 159. Alternatively (or additionally), the first and second ends of each roller chain 156 may include (or terminate into) cables that are coupled respectively to the support arm 122 and counterweight 159. Such cables can be guided over one or more pulleys (or other rolling components) positioned in-between the support arm 122 and the counterweight 159 when, for example, the vertical tracks 151 are not positioned in the rear housing 140, such as when the vertical tracks 151 are coupled to sides 145, as is illustrated in FIGS. 2A-2C.

As is discussed above, the rear housing 140 may include one or more vertical flat gears 155. The vertical flat gear 155 may allow the support shelf 120 to be locked and unlocked, as is discussed below. The vertical flat gear 155 may include spaced-apart teeth, as is illustrated in FIG. 3B. Additionally, a gear stop 256 may be sized to fit in the spaces in-between the teeth. For example, the gear stop 256 may include one or more protrusions that may each fit in the space in-between two teeth of the gear stop 256. In addition to fitting in the spaces in-between the teeth, the gear stop 256 may be coupled to the actuator 150. For example, the gear stop 256 may be coupled to a rod 154 by a clevis pin 257, and the rod 154 may be coupled to both the actuator 150 and the support shelf 120. Additionally, a coil spring 255 and spring tension adjuster 258 may surround the end of the rod 154 that is coupled to the gear stop 256, with the spring tension adjuster 258 being coupled to the support shelf 120 by a square nut 259.

When the actuator 150 is unengaged (or not engaged), the protrusions of the gear stop 246 may be positioned within the spaces in-between the teeth of the vertical flat gear 155. This positioning may lock the support shelf 120, thereby preventing the support shelf 120 from being moved vertically along the vertical tracks 151. For example, if a user (or a mechanism) attempts to move the support shelf 120 vertically upward, this upward force may be transferred from the support shelf 120, to the rod 154 (coupled to the support shelf 120), to the protrusions of the gears stop 246, and to the teeth of the vertical flat gear 155. In such an example, the teeth of the vertical flat gear 155 may resist that upward force, thereby preventing the support shelf 120 from moving vertically upward. Additionally, the teeth of the vertical flat gear 155 may also resist any downward force applied by the user (and/or gravity or a mechanism), thereby also preventing the support shelf 120 from moving vertically downward.

Alternatively, when the actuator 150 is engaged (e.g., by pulling the actuator 150 forward towards the handle 135), the actuator 150 may remove the protrusions from the spaces in-between the teeth of the vertical flat gear 155 (e.g., by urging the spring biased rod 154 forward to disengage the protrusions from the vertical flat gear 155). As such, the teeth of the vertical flat gear 155 may no longer resist upward (or downward) forces applied to the support shelf 120, thereby allowing the upward (or downward) forces to move the support shelf vertically along the vertical tracks 151. Additionally, when the support shelf 120 is positioned at a desired vertical position, the actuator 150 may once again be unengaged (e.g., by releasing the actuator 150, causing it to spring towards the rear housing 140). As such, the vertical flat gear 155 may once again lock the support shelf 120.

Figure 4B:
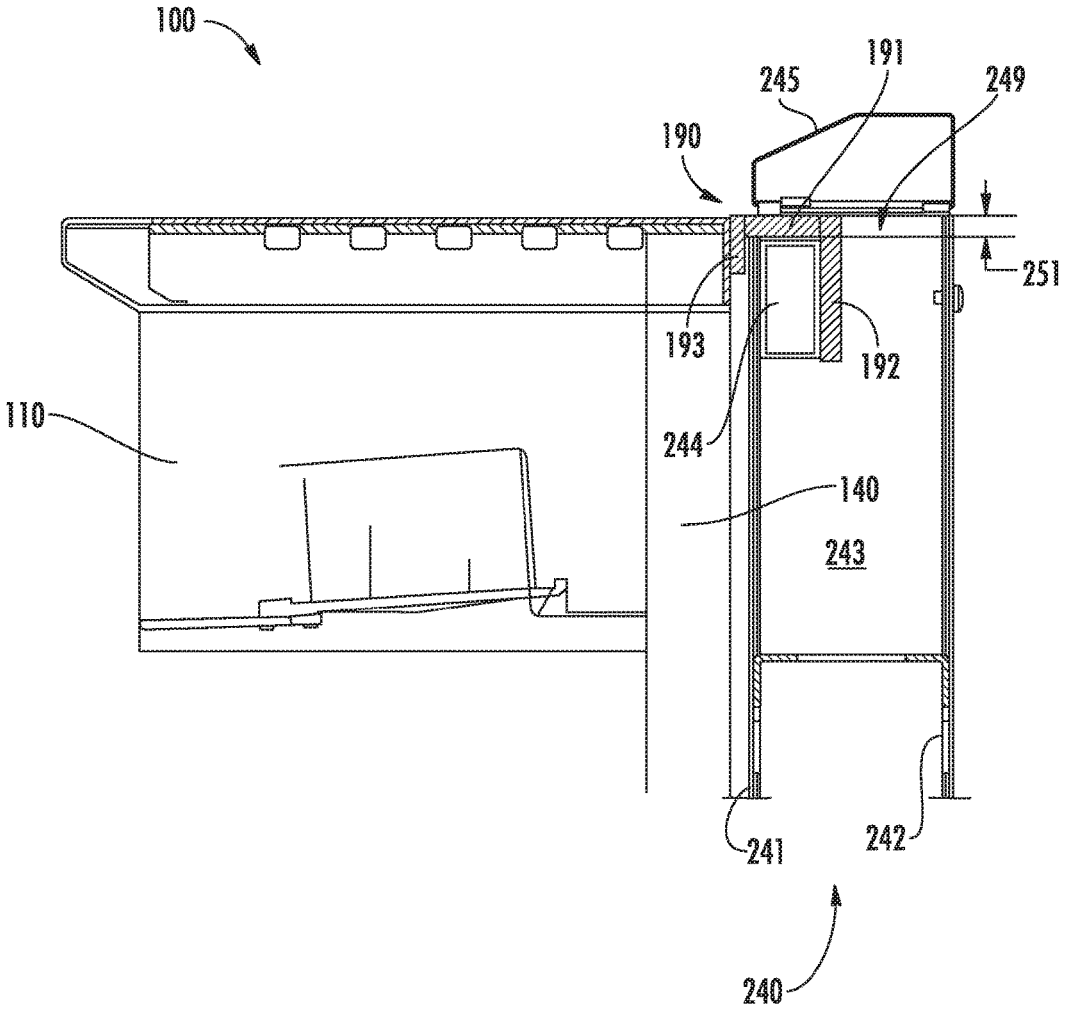

FIGS. 4A-4B illustrate an example of the cooking unit of FIGS. 1A-1B coupled to a vent flue. In particular, FIG. 4A illustrates a front perspective view of a cooking unit 100 coupled to a vent flue 240; and FIG. 4B illustrates an enlarged cross-sectional view of a portion of FIG. 4A.

The cooking unit 100 of FIGS. 4A-4B may be substantially similar to the cooking unit 100 described above with regard to FIGS. 1A-3B. However, as illustrated, the cooking unit 100 is coupled to a vent flue 240. The vent flue 240 may be any apparatus for venting gases. For example, the vent flue 240 may be a duct that receives hot combustion exhaust gases from one or more cooking appliances and vents the exhaust gases near ceiling vents in, for example, a kitchen. The vent flue 240 may receive gases from any number of cooking appliances.

As illustrated, the vent flue 240 has a cavity 243 (illustrated in FIG. 4B) with an upper opening 249 (illustrated in FIG. 4B) that may receive the brackets 190 when the cooking unit 100 is coupled to the vent flue 240. The cavity 243 may have any size and/or shape. For example, the cavity 243 may have a rectangular cross-section with a lateral length within a range of approximately (i.e., +/−0.5 inches) 6 inches to approximately 96 inches or greater, and a width (or depth) within a range of approximately (i.e., +/−0.5 inches) 3 inches to approximately 24 inches. As illustrated, the cavity 243 is a vertical cavity.

The cavity 243 may be defined by a front wall 241, a back wall 242, and two side walls 248. The front wall 241, back wall 242, and two side walls 248 may have any orientation with regard to each other. For example, the front wall 241 may be parallel to the back wall 242, the front wall 241 may be approximately (i.e., +/−5 degrees) parallel to the back wall 242, the front wall 241 and the back wall 242 may be oriented vertically away from each other in a V shape, the front wall 241 and the back wall 242 may be oriented vertically toward each other in an inverted V shape, any other orientation, or any combination of the preceding. Side walls 248 may be parallel to each other, approximately (i.e., +/−5 degrees) parallel to each other, any other orientation, or any combination of the preceding. Furthermore, side walls 248 may be oriented at 90 degree angles to each of the front wall 241 and the back wall 242, at 80 degree angles to each of the front wall 241 and the back wall 242, at 100 degree angles to each of the front wall 241 and the back wall 242, at approximately (i.e., +/−5 degrees) 90 degree angles to each of the front wall 241 and the back wall 242, at approximately 80 degree angles to each of the front wall 241 and the back wall 242, at approximately 100 degree angles to each of the front wall 241 and the back wall 242, any other angle, or any other approximate angle. As illustrated, the front wall 241 may have a rear face (or surface) within the cavity 243, and an opposing front face (or surface) outside of the cavity 243.

The front wall 241, back wall 242, and two side walls 248 may have any size. For example, the front wall 241 (and back wall 242) may have a lateral length within a range of approximately (i.e., +/−0.5 inches) 6 inches to approximately 96 inches or more. Furthermore, the front wall 241 may have a lateral length large enough to fit the cooking unit 100 entirely within the length of the front wall 241. Additionally, the front wall 241 may have a lateral length that is larger than the cooking unit 100. In such an example, this may allow the cooking unit 100 to be moved laterally (as is illustrated by arrow 250) along the length of the front wall 241 while the cooking unit 100 is coupled to the vent flue 240. The front wall 241 may extend upward to a first height and the back wall 242 may extend upward to a second height that is larger than the first height. This difference in height may create a height gap 251 (illustrated in FIG. 4B). The height gap 251 may be any size. For example, the size of the height gap 251 may be within a range of approximately (i.e., +/−0.1 inches) 0.25 inches to approximately 6 inches. The size of the height gap 251 may be based on the size of the top portion 191 of the brackets 190. For example, the size of the height gap 251 may be equal to or approximately (i.e., +/−0.5 inches) equal to the thickness of the top portion 191 of the brackets 190. In such an example, the brackets 190 may be inserted into the upper opening 249 of the cavity 243 of the vent flue 240, and the thickness of the top portion 191 may cause the top side of the top portion 191 to be level or approximately (i.e., +/−0.5 inches) level with the second height of the back wall 242. The height gap 251 may provide a space that allows the brackets 190 (and the cooking unit 100) to be moved laterally (shown as arrow 250) along the length of the vent flue 240. For example, the height gap 251 (along with the vent cap 245 discussed below) may create a continuous horizontal slot that allows the cooking unit 100 to be moved laterally without interference.

The front wall 241, back wall 242, and two side walls 248 may be made of (or constructed of) any material. For example, the front wall 241, back wall 242, and two side walls 248 may be made of steel, stainless steel, aluminum, iron, brass, titanium, any other metal or metal alloy (including coated, plated or clad metals), any other material, or any combination of the preceding.

The vent flue 240 further includes a support bar 244 positioned within the cavity 243. The support bar 244 may be any item for coupling (or otherwise connecting) to the vent flue 240 and further for supporting the cooking unit 100 when the cooking unit 100 in inserted into the cavity 243. For example, the support bar 244 may be a bar, a rod, a slab, a pipe, a panel, a board, a segment, any other item for coupling (or otherwise connecting) to the vent flue 240 and further for supporting the cooking unit 100 when the cooking unit 100 in inserted into the cavity 243.

The vent flue 240 may include any number of support bars 244. For example, the vent flue 240 may include 1 support bar 244, 2 support bars 244, 3 support bars 244, 4 support bars 244, or any other number of support bars 244. As illustrated, the vent flue 240 includes 1 support bar 244. The support bar 244 may be made of (or constructed of) any material. For example, the support bar 244 may be made of stainless steel, aluminum, iron, brass, titanium, any other metal or metal alloy (including coated, plated or clad metals), any other material, or any combination of the preceding. Additionally, the support bar 244 may be hollow, or it may be solid. As illustrated, the support bar 244 is hollow, thereby allowing the support bar 244 to achieve a high stiffness at a lower mass.

The support bar 244 may have any shape. For example, the support bar 244 may have a side or cross-section that is shaped as a rectangle, a square, a circle, an irregular shape, any other shape, or any combination of the preceding. As illustrated, the cross section of the support bar 244 is shaped as a rectangle. The support bar 244 may also have any size for supporting the cooking unit 100 when the cooking unit 100 in inserted into the cavity 243. For example, the support bar 244 may have a thickness within a range of approximately (i.e., +/−0.5 inches) 1 inch to approximately 6 inches. The thickness of the support bar 244 may be based on both the size of the gap 194 of the brackets 190 and the thickness of the front wall 241. For example, the thickness of the support bar 244 may be equal to or approximately (i.e., +/−0.5 inches) equal to the size of the gap 194 of the brackets 190, minus the thickness of the front wall 241. In such an example, the support bar 244 may fit within the gap 194 of the brackets 190, entirely (or approximately) filling the portion of the gap 194 of the brackets 190 that is not already filled by the thickness of the front wall 241 of the vent flue 240 (as is illustrated in FIG. 4B). As such, the support bar 244 may distribute the stress caused by the load of the cooking unit 100 when the cooking unit 100 is coupled to the vent flue 240.

The support bar 244 may be positioned at any location within the cavity 243. For example, the support bar 244 may be coupled to the rear face of the front wall 241 of the vent flue 240. The support bar 244 may also be positioned at any height within the cavity 243. For example, the support bar 244 may be coupled adjacent to the first height of the front wall 241. In such an example, the top surface of the support bar 244 may be level or approximately (i.e., +/−0.1 inches) level with the top surface of the front wall 241, as is illustrated in FIG. 4B.

The support bar 244 may be coupled to the vent flue 240 (such as the rear face of the front wall 241 of the vent flue 240) in any manner. For example, the support bar 244 may be bolted to the vent flue 240, screwed to the vent flue 240, riveted to the vent flue 240, clipped or snapped into the vent flue 240, welded to the vent flue 240, bonded to the vent flue 240, formed integral with the vent flue 240, coupled to the vent flue 240 (such as the rear face of the front wall 241 of the vent flue 240) in any other manner, or any combination of the preceding.

The support bar 244 may be oriented in any manner that may allow the support bar 244 to support the cooking unit 100 when the cooking unit 100 is inserted into the cavity 243. For example. the support bar 244 may be oriented horizontally, vertically, at any angle in-between horizontal and vertical, or any other angle. As illustrated, the support bar 244 is oriented horizontally.

As illustrated, the vent flue 240 further includes a vent cap 245 coupled to the vent flue 240. The vent cap 245 may be any apparatus that may allow gases to vent out of the cavity 243. The vent cap 245 may have one or more perforations that may allow the gases to pass through the vent cap 245. The vent cap 245 may have any number of perforations, and the perforations may have any shape and/or size. Furthermore, the perforations may be angled so as to direct the gases out of the vent cap 245 at a particular angle.

The vent cap 245 may be coupled to the vent flue 240 at any location that allows the vent cap 245 to vent exhaust gases out of the cavity 243. For example, as is illustrated, the vent cap 245 may be coupled on top of the vent flue 240 so as to be located above the upper opening 249 of the cavity 243 of the vent flue 240. The vent cap 245 may be coupled to the vent flue 240 (such as the top of the vent flue 240) in any manner. For example, the vent cap 245 may be bolted to the vent flue 240, screwed to the vent flue 240, riveted to the vent flue 240, clipped or snapped into the vent flue 240, welded to the vent flue 240, formed integral with the vent flue 240, bonded to the vent flue 240 (such as the top of the vent flue 240) in any other manner, or any combination of the preceding.

Although the vent cap 245 may be coupled to the vent flue 240, such a coupling preferably does not block, cover, or otherwise impede a portion of the height gap 251 in-between the first height of the front wall 241 and the second height of the back wall 242. For example, the height gap 251 (or a portion of the height gap 251) may create a spacing in-between the top edge (or surface) of the front wall 241 and the bottom edge (or surface) of the vent cap 245. This spacing may create a continuous horizontal slot that allows the cooking unit 100 to be coupled to the vent flue 240. As such, the vent flue 240 may include the vent cap 245 even when the cooking unit 100 is coupled to the vent flue 240. Furthermore, this horizontal slot may also allow the cooking unit 100 to be moved laterally (as is illustrated by arrow 250) along the length of the vent flue 240 even while the vent cap 245 is coupled to the vent flue 240. As such, the cooking unit 100 may be moved (or repositioned) without the vent cap 245 having to be removed.

As illustrated, the vent cap 245 includes cap sides 246 (illustrated in FIG. 4A) coupled to each side of the vent cap 245. These cap sides 246 may allow the vent cap 245 to enclose the cavity 243 (other than the height gap 251 in-between the first height of the front wall 241 and the second height of the back wall 242). As such, all (or substantially all) of the gases in the cavity 243 may be vented through the perforations of the vent cap 245. The cap sides 246 may be coupled to the vent cap 245 in any manner. For example, the cap sides 246 may be bolted to the vent cap 245, screwed to the vent cap 245, riveted to the vent cap 245, clipped or snapped to the vent cap 245, welded to the vent cap 245, bonded to the vent cap 245, formed integral with the vent cap 245, coupled to the vent cap 245 in any other manner, or any combination of the preceding.

As is discussed above, the cooking unit 100 may be coupled to the vent flue 240. The cooking unit 100 may be coupled to the vent flue 240 in any manner. For example, the cooking unit 100 may be coupled to the vent flue 240 by inserting the brackets 190 of the cooking unit 100 into the upper opening 249 of the cavity 243 of the vent flue 240. By doing so, the rear leg 192 of the bracket 190 may be inserted between the front wall 241 and the back wall 242 of the vent flue 240, and be positioned against the back surface of the support bar 244, as is illustrated in FIG. 4B. Additionally, the support bar 244 may be positioned within the gap 194 in-between the rear leg 192 and the front leg 193, as is also illustrated in FIG. 4B. Furthermore, the front leg 193 of the bracket 190 may be positioned against the front face of the front wall 241, and the top portion 191 of the bracket 190 may be positioned against the top surface of the front wall 241 and the top surface of the support bar 244, as is also illustrated in FIG. 4B. Such a coupling may cause the rear housing 140 to be positioned against the front face of the front wall 241, thereby causing the rear housing 140 to be oriented parallel to the front wall 241.

The cooking unit 100 may be coupled to the vent flue 240 before the vent cap 245 is coupled to the vent flue 240. In such an example, after the cooking unit 100 is coupled to the vent flue 240, the vent cap 245 may be coupled to the vent flue 240.

Although FIGS. 4A-4B illustrate the cooking unit 100 coupled to a vent flue 240, the cooking unit 100 may be coupled to any other structure associated with a kitchen. For example, the cooking unit 100 may be coupled to a kitchen table, a kitchen cabinet, a kitchen door, any other structure associated with a kitchen, or any combination of the preceding. Furthermore, the cooking unit 100 may also be coupled to any other structure, whether or not the structure is associated with a kitchen.

Figures 5A, 5B:
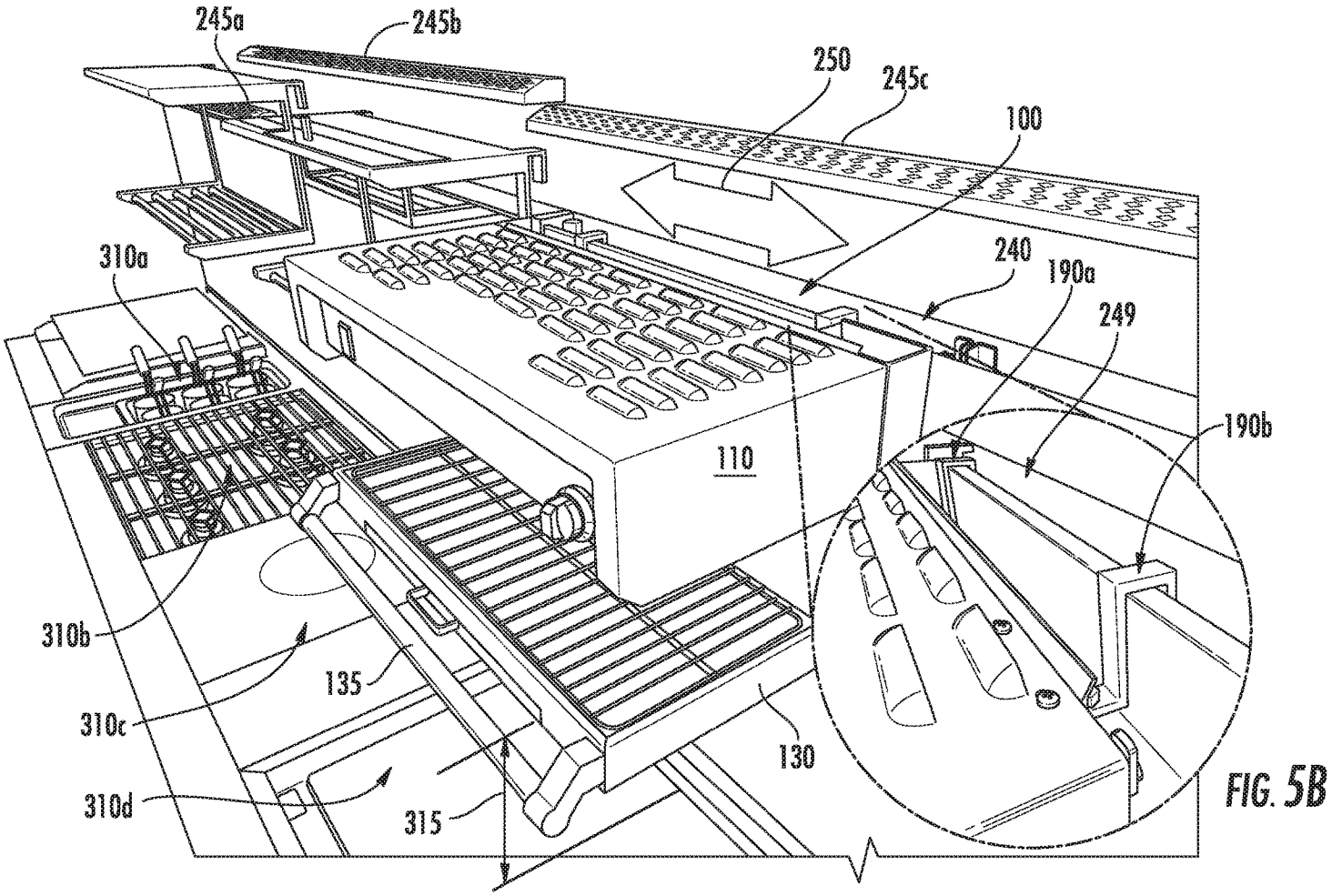
FIGS. 5A-5B illustrate an example of a kitchen area that utilizes a cooking unit.

FIGS. 5A-5B illustrate an example of a kitchen area that utilizes a cooking unit. In particular, FIG. 5A illustrates a partially assembled perspective view of a kitchen area 300 that utilizes a cooking unit 100 and a vent flue 240; and FIG. 5B illustrates an enlarged view of the encircled portion of FIG. 5A. The kitchen area 300 may be any area of any type of kitchen. For example, the kitchen area 300 may be a portion of a cooking line in a food industry kitchen.

As illustrated, the kitchen area 300 includes a cooking unit 100. The cooking unit 100 may be substantially similar to the cooking unit described above with regard to FIGS. 1A-4B. Furthermore, the kitchen area 300 may include any number of cooking units 100. For example, the kitchen area 300 may include 1 cooking unit 100, 2 cooking units 100, 3 cooking units 100, 4 cooking units 100, 5 cooking units 100, 10 cooking units 100, 20 cooking units 100, or any other number of cooking units 100. As illustrated, the kitchen area 300 includes 1 cooking unit 100.

The kitchen area 300 further includes a vent flue 240. The vent flue 240 may be substantially similar to the vent flue 240 described above with regard to FIGS. 4A-4B. Furthermore, the kitchen area 300 may include any number of vent flues 240. For example, the kitchen area 300 may include 1 vent flue 240, 2 vent flues 240, 3 vent flues 240, 4 vent flues 240, 5 vent flues 240, 10 vent flues 240, 20 vent flues 240, or any other number of vent flues 240. As illustrated, the kitchen area 300 includes a single vent flue 240 that extends laterally along the entire length of the kitchen area 300. As discussed above with regard to FIGS. 4A-4B, the vent flue 240 may include one or more support bars 244, and one or more vent caps 245 coupled to the vent flue 240.

As is illustrated, the cooking unit 100 may be coupled to the vent flue 240. A cooking unit 100 may be coupled to the vent flue 240 in any manner. For example, the cooking unit 100 may be coupled to the vent flue 240 by inserting the brackets 190 of the cooking unit 100 into the upper opening 249 of the cavity 243 of the vent flue 240, as is discussed above with regard to FIGS. 4A-4B. When coupled to the vent flue 240, the cooking unit 100 may be moved laterally (as is illustrated by arrow 250) along the length of the vent flue 240 even while the vent cap 245 (such as each of vent caps 245*a*-245*c*) is coupled to the vent flue 240.

As illustrated, the kitchen area 300 further includes kitchen appliances 310. A kitchen appliance 310 may be any apparatus that may be used in a kitchen (such as to cook food). For example, a kitchen appliance 310 may be a fryer, a grill, a cooking range (such as a French Top cooking range), an oven, a smoker, a table top, a dishwasher, a sink, a trash compactor, any other apparatus that may be used in a kitchen, or any combination of the preceding.

The kitchen area 300 may include any number of kitchen appliances 310. For example, the kitchen area 300 may include 1 kitchen appliance 310, 2 kitchen appliances 310, 3 kitchen appliances 310, 4 kitchen appliances 310, 6 kitchen appliances 310, 10 kitchen appliances 310, 20 kitchen appliances 310, or any other number of kitchen appliances 310. As illustrated, the kitchen area 300 includes a fryer as a first cooking appliance 310*a*, a grill as a second cooking appliance 310*b*, a French Top cooking range as a third cooking appliance 310*c*, and an oven as a fourth cooking appliance 310*d*.

The kitchen appliance 310 may be in fluid communication with the vent flue 240. For example, as is illustrated, the fourth cooking appliance 310*d* is an oven. This oven may be a gas combustion oven. Furthermore, a portion of the combustion gases of the oven (such as the hot combustion exhaust gases) may be directed from the oven into the vent flue 240, so as to vent out of the cavity 243 of the vent flue 240. As such, these hot combustion exhaust gases may be vented near ceiling vents, for example, in the kitchen area 300. Any number of the kitchen appliances 310 in the kitchen area 300 may be in fluid communication with the vent flue 240. For example, only one kitchen appliance 310 may be in fluid communication with the vent flue 240, none of the kitchen appliances 310 may be in fluid communication with the vent flue 240, all of the kitchen appliances 310 may be in fluid communication with the vent flue 240, or any other number of kitchen appliances 310 may be in fluid communication with the vent flue 240.

The cooking unit 100 and the kitchen appliance 310 may be positioned in any manner with respect to each other. For example, the cooking unit 100 may be positioned directly above the kitchen appliance 310, laterally to left of the kitchen appliance 310, laterally to right of the kitchen appliance 310, half above the kitchen appliance 310 and half above another area of the kitchen area 300, or positioned at any other location with respect to the kitchen appliance 310. Furthermore, because the lateral position of the cooking unit 100 may be changed (such as by sliding the cooking unit 100 laterally along the vent flue 240), the positioning of the cooking unit 100 with respect to the kitchen appliance 310 may also be changed. As is illustrated, the cooking unit 100 is positioned above the oven kitchen appliance 310*d*.

The cooking unit 100 may further be positioned with respect to a kitchen appliance 310 so as to have a vertical spacing in-between the cooking unit 100 and the kitchen appliance 310. For example, the cooking unit 100 may be positioned so that there is a vertical spacing 315 in-between the top of the kitchen appliance 310 (such as the top of the oven kitchen appliance 310*d*) and the support shelf 120 and sliding tray 130 of the cooking unit 100. This vertical spacing 315 may be any distance. For example, the vertical spacing 315 may be 6 inches, 1 foot, 1.5 feet, 2 feet, 2.5 feet, 3 feet, 4 feet, 5 feet, or any other distance. As another example, the vertical spacing 315 may be approximately (i.e., +/−3 inches) 6 inches, approximately 1 foot, approximately 1.5 feet, approximately 2 feet, approximately 2.5 feet, approximately 3 feet, approximately 4 feet, approximately 5 feet, or any other approximate distance. The vertical spacing 315 may create a work space in-between the top of the kitchen appliance 310 and the support shelf 120 and sliding tray 130 of the cooking unit 100. This work space may allow kitchen personnel to use the top of the kitchen appliance 310 (such as use the top of the kitchen appliance 310 to cook food, prepare food, or store dishes) without running into a portion of the cooking unit 100.

Additionally, the vertical spacing 315 may be adjusted. For example, using the actuator 150 of the cooking unit 100, support shelf 120 (and sliding tray 130) of the cooking unit 100 may be moved vertically along the vertical tracks 151. This movement may raise the support shelf 120 (and sliding tray 130) toward the heating chamber 110, creating a larger vertical distance 315. As such, kitchen personnel may have more work space to operate in. Furthermore, food (and/or other items) positioned on the sliding tray 130 may receive more heat from the heating chamber 110. Alternatively, the movement may lower the support shelf 120 (and sliding tray 130) away from the heating chamber 110, creating a smaller vertical distance 315. As such, food (or other items) positioned on the sliding tray 130 may receive less heat from the heating chamber 110. Additionally, the lower positioning of the sliding tray 130 may allow for easier loading and/or unloading of food (or other items) from the sliding tray 130.

The cooking unit 100 and the kitchen appliance 310 may further be positioned in any manner with respect to the vent flue 240. For example, the cooking unit 100 (and/or the kitchen appliance 310) may be positioned in the middle of the lateral length of the vent flue 240, on the left of the lateral length of the vent flue 240, on the right of the lateral length of the vent flue 240, or any other position along the lateral length of the vent flue 240. Additionally, due to size of the lateral length of the vent flue 240, the vent flue 240 may extend laterally beyond the length of the cooking unit 100, the kitchen appliance 310, or both the cooking unit 100 and the kitchen appliance 310. As such, the cooking unit 100 may be moved laterally along the length of the vent flue 240 to be positioned at any location with respect to the kitchen appliance 310, as is discussed above.

Modifications, additions, combinations, or omissions may be made to the cooking unit 100, vent flue 240, kitchen appliances 310, and/or any other elements of FIGS. 1A-5B without departing from the scope of the disclosure. For example, any number of cooking units 100 (e.g., two or more cooking units 100) may be coupled to a vent flue 240 (or any other structure). Additionally, any of the elements of any of FIGS. 1A-5B may be added to, combined with, or substituted for any of the elements of any other of the FIGS. 1A-5B.

Figure 6:
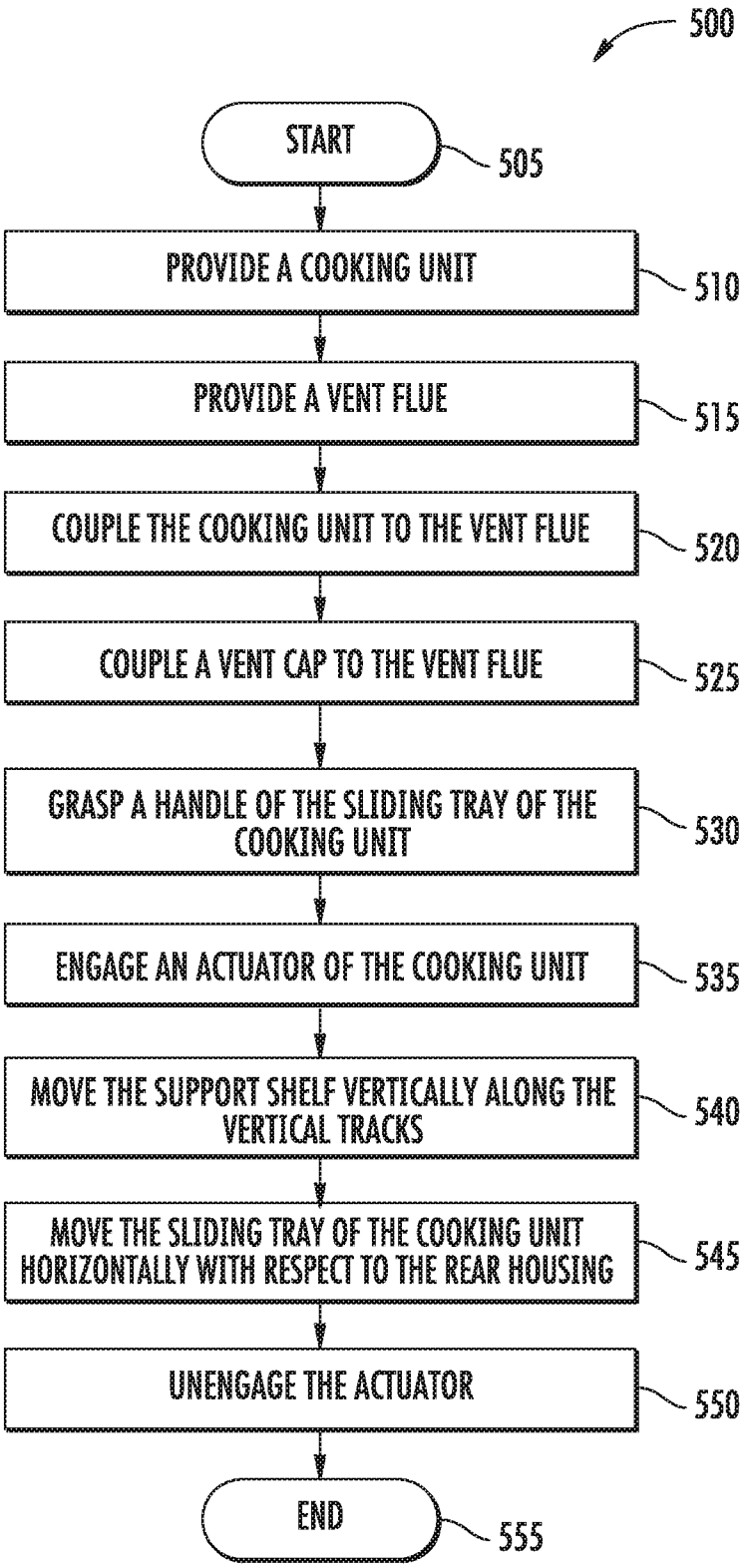
FIG. 6 illustrates an example method of installing and/or using a cooking unit.

FIG. 6 illustrates an example method of installing and/or using a cooking unit. One or more of the steps (such as all of the steps) of method 500 may be performed using the cooking unit 100 of FIGS. 1A-5B, the vent flue 240 of FIGS. 4A-5B, and/or any of the other elements of FIGS. 1A-5B. Furthermore, one or more of the steps (such as all of the steps) of method 500 may be performed by a manufacturer of a cooking unit, a re-seller of a cooking unit, a shipper of a cooking unit, an installer of a cooking unit, and/or a user of a cooking unit. Additionally, one or more of the steps of method 500 may be performed by different entities.

The method 500 begins at step 505. At step 510, a cooking unit 100 may be provided. The cooking unit 100 may be provided in any manner. For example, the cooking unit 100 may be built, purchased, shipped, acquired, received, provided in any other manner, or any combination of the preceding.

At step 515, a vent flue 240 may be provided. The vent flue 240 may be provided in any manner. For example, the vent flue 240 may be built, purchased, shipped, acquired, received, installed, provided in any other manner, or any combination of the preceding.

The vent flue 240 may be provided with one or more support bars 244 already added to the vent flue 240. Alternatively, the step 515 may further include adding one or more support bars 244 to the vent flue 240. A support bar 244 may be positioned at any location within the cavity 243 of the vent flue 240. For example, the support bar 244 may be coupled to the rear face of the front wall 241 of the vent flue 240. The support bar 244 may also be positioned at any height within the cavity 243 of the vent flue 240. For example, the support bar 244 may be coupled adjacent to the first height of the front wall 241. In such an example, the top surface of the support bar 244 may be level or approximately (i.e., +/−0.1 inches) level with the top surface of the front wall 241, as is illustrated in FIG. 4B. Additionally, the support bar 244 may be coupled to the vent flue 240 (such as the rear face of the front wall 241 of the vent flue 240) in any manner. For example, the support bar 244 may be bolted to the vent flue 240, screwed to the vent flue 240, riveted to the vent flue 240, clipped or snapped into the vent flue 240, welded to the vent flue 240, bonded to the vent flue 240, formed integral with the vent flue 240, coupled to the vent flue 240 (such as the rear face of the front wall 241 of the vent flue 240) in any other manner, or any combination of the preceding.

At step 520, the cooking unit 100 may be coupled to the vent flue 240. The cooking unit 100 may be coupled to the vent flue 240 in any manner. For example, the cooking unit 100 may be coupled to the vent flue 240 by inserting the brackets 190 of the cooking unit 100 into the upper opening 249 of the cavity 243 of the vent flue 240. By doing so, the rear leg 192 of the bracket 190 may be inserted between the front wall 241 and the back wall 242 of the vent flue 240, and be positioned against the back surface of the support bar 244, as is illustrated in FIG. 4B. Additionally, the support bar 244 may be positioned within the gap 194 in-between the rear leg 192 and the front leg 193, as is also illustrated in FIG. 4B. Furthermore, the front leg 193 of the bracket 190 may be positioned against the front face of the front wall 241, and the top portion 191 of the bracket 190 may be positioned against the top surface of the front wall 241 and the top surface of the support bar 244, as is also illustrated in FIG. 4B. Such a coupling may cause the rear housing 140 to be positioned against the front face of the front wall 241, thereby causing the rear housing 140 to be oriented parallel to the front wall 241.

At step 525, a vent cap 245 may be coupled to the vent flue 240. The vent cap 245 may be coupled to the vent flue 240 at any location that allows the vent cap 245 to vent gases out of the cavity 243. For example, as is illustrated, the vent cap 245 may be coupled on top of the vent flue 240 so as to be located above the upper opening 249 of cavity 243 of the vent flue 240. In such an example, the vent cap 245 may cover the vent flue 240. The vent cap 245 may be coupled to the vent flue 240 in any manner. For example, the vent cap 245 may be bolted to the vent flue 240, screwed to the vent flue 240, nailed to the vent flue 240, clipped or snapped into the vent flue 240, welded to the vent flue 240, formed integral with the vent flue 240, coupled to the vent flue 240 in any other manner, or any combination of the preceding. Although the vent cap 245 may be coupled to the vent flue 240, such a coupling preferably does not block, cover, or otherwise impede a portion of the height gap 251 in-between the first height of the front wall 241 and the second height of the back wall 242. For example, the height gap 251 (or a portion of the height gap 251) may create a spacing in-between the top edge of the front wall 241 and the bottom edge of the vent cap 245. This spacing may create a continuous horizontal slot that may allow the cooking unit 100 to be coupled to the vent flue 240 and that may also allow the cooking unit 100 to be moved laterally (as is illustrated by arrow 250 of FIGS. 4A and 5A) along the length of the vent flue 240 even while the vent cap 245 is coupled to the vent flue 240.

At step 530, the handle 135 of the sliding tray 130 of the cooking unit 100 may be grasped. The handle 135 may be grasped with a single hand of a user. Furthermore, the handle 135 may be grasped in any manner.

At step 535, an actuator 150 of the cooking unit 100 may be engaged. The actuator 150 may be engaged using the same single hand of the user. Furthermore, the actuator 150 may be engaged in any manner. For example, the actuator 150 may be engaged by moving the actuator 150 (e.g., moving the actuator 150 using a finger), pulling the actuator 150 forward (or out), pushing the actuator 150 backward (or in), depressing the actuator 150 (e.g., depressing a button), twisting the actuator 150, moving the actuator 150 laterally (e.g., to the left or right), moving the actuator 150 vertically (e.g., up or down), grasping the actuator 150 (e.g., using a single hand to co-grasp both the handle 135 and the actuator 150 by placing the palm of the hand on or around the handle 135 and placing one or more fingers on or through the actuator 150 in a grasping motion), any other manner of engaging the actuator 150, or any combination of the preceding. Such an engagement of the actuator 150 may occur after the hand is already grasping the handle 135, immediately before the hand grasps the handle 135, or at substantially the same time as the hand grasping the handle 135 (i.e., both actions occur during the same motion of the hand). Furthermore, by engaging the actuator 150, the support shelf 120 of the cooking unit 100 may be unlocked, allowing the support shelf 120 to be moved vertically along the vertical tracks 151.

At step 540, the support shelf 120 may be moved vertically along the vertical tracks 151. The support shelf 120 may be moved in any vertical direction. For example, the support shelf 120 may be raised (or moved vertically upward) toward the heating chamber 110. As another example, the support shelf 120 may be lowered (or moved vertically downward) away from the heating chamber 120. The support shelf 120 may be moved vertically along the vertical tracks 151 in any manner. For example, the support shelf 120 may be manually moved (such as by a user of cooking unit 120 applying force to the support shelf 120). In such an example, a user may use the same single hand (that is grasping the handle 135 and engaging the actuator 150) to apply force to the handle 135, causing the support shelf 120 to move vertically. As further examples, the support shelf 120 may be mechanically moved (such as by one or more motors, gears, and/or springs), magnetically moved, moved in any other manner, or any combination of the preceding.

At step 545, the sliding tray 130 of the cooking unit 110 may be moved horizontally with respect to the rear housing 140. For example, the sliding tray 130 may be moved horizontally toward the rear housing 140. As another example, the sliding tray 130 may be moved horizontally away from the rear housing 140. The sliding tray 130 may be moved horizontally in any manner. For example, the sliding tray 130 may be manually moved (such as by a user of cooking unit 100 by applying force to the sliding tray 130). In such an example, a user may use the same single hand (that is grasping the handle 135 and that may engage the actuator 150) to apply horizontal force to the handle 135, causing the sliding tray 130 to move horizontally.

The sliding tray 130 may be moved horizontally while the support shelf 120 is at a maximum vertical position, a minimum vertical position, any other vertical position in-between the maximum and minimum vertical position, and/or while the support shelf 130 is being moved vertically. Furthermore, the support shelf 120 may be moved vertically toward (or away from) the heating chamber 110 while the sliding tray 130 is at a maximum forward horizontal position with respect to the rear housing 140, a minimum forward horizontal position with respect to the rear housing 140, any other horizontal position in-between the maximum and minimum forward horizontal position with respect to the rear housing 140, and/or while the sliding tray 130 is being moved horizontally. In some examples, the sliding tray 130 may not be moved horizontally toward (or way from) the rear housing 140 while the support shelf 120 is being moved vertically, and/or the support shelf 120 may not be moved vertically toward (or away from) the heating chamber 110 while the sliding tray 130 is being moved horizontally.

At step 550, the actuator 150 may be unengaged. The actuator 150 may be unengaged using the same single hand of the user. Furthermore, the actuator 150 may be unengaged in any manner. For example, the actuator 150 may be unengaged by reversing the motion that engaged the actuator 150, releasing the actuator 150 from being engaged (which may cause the actuator 150 to move back to the unengaged position), any other manner of unengaging the actuator 150, or any combination of the preceding. By unengaging the actuator 150, the support shelf 120 may be locked, preventing the support shelf 120 from being moved vertically along the vertical tracks 151. At step 555, the method 500 may end.

Modifications, additions, or omissions may be made to method 500. For example, the method 500 may not include one or more of the steps. Additionally, the steps of method 500 may be performed in parallel or in any suitable order. For example, steps 550 and 545 may be reversed. In such an example, the actuator 150 may be unengaged before the sliding tray 130 of the cooking unit 110 may be moved horizontally with respect to the rear housing 140.

This specification has been written with reference to various non-limiting and non-exhaustive embodiments or examples. However, it will be recognized by persons having ordinary skill in the art that various substitutions, modifications, or combinations of any of the disclosed embodiments or examples (or portions thereof) may be made within the scope of this specification. Thus, it is contemplated and understood that this specification supports additional embodiments or examples not expressly set forth in this specification. Such embodiments or examples may be obtained, for example, by combining, modifying, or reorganizing any of the disclosed steps, components, elements, features, aspects, characteristics, limitations, and the like, of the various non-limiting and non-exhaustive embodiments or examples described in this specification. In this manner, Applicant reserves the right to amend the claims during prosecution to add features as variously described in this specification.

What is claimed is:

1. A cooking unit, comprising:

a rear housing;

a horizontal gas combustion chamber coupled to the rear housing, the horizontal gas combustion chamber being operable to direct heat downward;

a pair of vertical tracks coupled to the rear housing;

a horizontal support shelf coupled to the pair of vertical tracks and positioned below the horizontal gas combustion chamber, the horizontal support shelf being operable to be moved vertically along the pair of vertical tracks;

a horizontal sliding tray coupled to the horizontal support shelf and positioned above the horizontal support shelf, the horizontal sliding tray being operable to be moved horizontally with respect to the rear housing;

a handle coupled to a front surface of the horizontal sliding tray;

an actuator positioned adjacent to the handle so as to allow both the handle to be grasped and the actuator engaged by a single hand of a user, the actuator being operable, when engaged, to unlock the horizontal support shelf so as to allow the horizontal support shelf to be moved vertically along the pair of vertical tracks using the handle and the single hand of the user, the actuator being further operable, when not engaged, to lock the horizontal support shelf so as to prevent the horizontal support shelf from being moved vertically along the pair of vertical tracks;

a vertical flat gear coupled to the rear housing, wherein the vertical flat gear is positioned laterally in-between the pair of vertical tracks; and a gear stop having a portion positioned in a portion of the vertical flat gear, wherein the gear stop is coupled, at least indirectly, to the actuator, wherein the actuator is operable, when engaged, to remove the portion of the gear stop from the position in the portion of the vertical flat gear so as to unlock the horizontal support shelf.

2. The cooking unit of claim 1, wherein the cooking unit is operable to be coupled to a vent flue.

3. The cooking unit of claim 1, further comprising a pair of brackets coupled to a rear face of the rear housing, the pair of brackets being operable to be inserted into an upper opening of a cavity of a vent flue.

4. A cooking unit, comprising:

a rear housing;

a horizontal heating chamber coupled to the rear housing, the horizontal heating chamber being operable to direct heat downward;

one or more vertical tracks coupled to the rear housing;

a horizontal support shelf coupled to the one or more vertical tracks and positioned below the horizontal heating chamber, the horizontal support shelf being operable to be moved vertically along the one or more vertical tracks;

a horizontal sliding tray coupled to the horizontal support shelf and positioned above the horizontal support shelf, the horizontal sliding tray being operable to be moved horizontally with respect to the rear housing;

a handle coupled to a front surface of the horizontal sliding tray; and an actuator positioned adjacent to the handle so as to allow both the handle to be grasped and the actuator engaged by a single hand of a user, the actuator being operable, when engaged, to unlock the horizontal support shelf so as to allow the horizontal support shelf to be moved vertically upward and downward along the one or more vertical tracks using the handle and the single hand of the user, the actuator being further operable, when not engaged, to lock the horizontal support shelf so as to prevent the horizontal support shelf from being moved vertically upward and downward along the one or more vertical tracks.

5. The cooking unit of claim 4, wherein the horizontal heating chamber is a horizontal gas combustion chamber.

6. The cooking unit of claim 4, wherein the one or more vertical tracks comprise at least two vertical tracks.

7. The cooking unit of claim 4, further comprising:

a vertical flat gear coupled to the rear housing; and a gear stop having a portion positioned in a portion of the vertical flat gear, wherein the gear stop is coupled, at least indirectly, to the actuator, wherein the actuator is operable, when engaged, to remove the portion of the gear stop from the position in the portion of the vertical flat gear so as to unlock the horizontal support shelf.

8. The cooking unit of claim 7, wherein the one or more vertical tracks comprise two vertical tracks, and the vertical flat gear is positioned laterally in-between the two vertical tracks.

9. The cooking unit of claim 4, wherein the horizontal support shelf is further operable to be moved vertically along the one or more vertical tracks while the horizontal sliding tray is positioned at a maximum forward horizontal position with respect to the rear housing.

10. The cooking unit of claim 4, wherein the actuator is operable to be moved forward towards the handle so as to be engaged.

11. The cooking unit of claim 4, wherein the cooking unit is operable to be coupled to a vent flue.

12. The cooking unit of claim 4, further comprising a pair of brackets coupled to a rear face of the rear housing, the pair of brackets being operable to be inserted into an upper opening of a cavity of a vent flue.

13. The cooking unit of claim 4, wherein the actuator is positioned within a range of approximately 6 inches-approximately 1 inch from the handle, so as to allow both the handle to be grasped and the actuator engaged by the single hand of the user.

14. The cooking unit of claim 4, wherein the actuator is positioned less than approximately 3 inches from the handle, so as to allow both the handle to be grasped and the actuator engaged by the single hand of the user.

15. A method, comprising:

providing a cooking unit, the cooking unit comprising:

a rear housing;

a horizontal heating chamber coupled to the rear housing, the horizontal heating chamber being operable to direct heat downward;

one or more vertical tracks coupled to the rear housing;

a horizontal support shelf coupled to the one or more vertical tracks and positioned below the horizontal heating chamber;

a horizontal sliding tray coupled to the horizontal support shelf and positioned above the horizontal support shelf;

a handle coupled to a front surface of the horizontal sliding tray; and an actuator positioned adjacent to the handle;

grasping the handle with a first hand;

engaging the actuator with the first hand so as to unlock the horizontal support shelf;

moving the horizontal support shelf vertically upward or downward along the one or more vertical tracks using the handle; and disengaging the actuator so as to lock the horizontal support shelf to prevent the horizontal support shelf from being moved vertically upward and downward along the one or more vertical tracks.

16. The method of claim 15, wherein moving the horizontal support shelf vertically along the one or more vertical tracks using the handle comprises raising the horizontal support shelf toward the horizontal heating chamber.

17. The method of claim 15, wherein moving the horizontal support shelf vertically along the one or more vertical tracks using the handle comprises lowering the horizontal support shelf away from the horizontal heating chamber.

18. The method of claim 15, further comprising unengaging the horizontal support shelf so as to lock the horizontal support shelf to prevent the horizontal support shelf from being moved vertically along the one or more vertical tracks.

19. The method of claim 15, wherein engaging the actuator with the first hand comprises moving the actuator toward the handle using the first hand.

20. The method of claim 15, further comprising moving the horizontal sliding tray horizontally with respect to the rear housing.

21. The method of claim 15, further comprising:

providing a vent flue; and coupling the cooking unit to the vent flue.

22. The method of claim 15, wherein the cooking unit further comprises a pair of brackets coupled to a rear face of the rear housing; and wherein the method further comprises inserting the pair of brackets into an upper opening of a cavity of the vent flue.

* * * * *